US010124859B2

(12) United States Patent
Burnett et al.

(10) Patent No.: US 10,124,859 B2
(45) Date of Patent: Nov. 13, 2018

(54) WATERCRAFT

(71) Applicant: YAMAHA HATSUDOKI KABUSHIKI KAISHA, Iwata, Shizuoka (JP)

(72) Inventors: Dean Burnett, Marietta, GA (US); Jeff Hudson, Woodstock, GA (US); Ritsu Kadota, Maryville, TN (US); Taku Ikeda, Kennesaw, GA (US)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 183 days.

(21) Appl. No.: 14/930,854

(22) Filed: Nov. 3, 2015

(65) Prior Publication Data

US 2017/0120986 A1 May 4, 2017

(51) Int. Cl.
*B63B 1/08* (2006.01)
*B63B 3/48* (2006.01)
(Continued)

(52) U.S. Cl.
CPC ..... *B63B 3/48* (2013.01); *B63B 1/08* (2013.01); *B63B 17/04* (2013.01); *B63B 29/02* (2013.01);
(Continued)

(58) Field of Classification Search
CPC ..... B63B 1/08; B63B 3/48; B63B 2003/485; B63B 17/04; B63B 2017/045; B63B 29/02; B63B 29/04; B63B 2029/022; B63B 2029/043; B63H 20/04; B63H 20/02; B63H 2020/003
See application file for complete search history.

(56) References Cited

U.S. PATENT DOCUMENTS 1,840,948 A * 1/1932 Harvey ..... B63H 20/04 440/63
3,348,794 A * 10/1967 Hayes ..... B63H 20/04 114/39.22
(Continued)

FOREIGN PATENT DOCUMENTS

ES 2386066 A1 8/2012
JP 05278672 A * 10/1993
(Continued)

OTHER PUBLICATIONS

Carolina Classic 25 (2014-), www.boattest.com/review/carolina-classic/3125_25, Copyright 2015 (available prior to Jun. 2015), pp. 1-10.

*Primary Examiner* — Ajay Vasudeva

(57) ABSTRACT

An outboard motor boat is provided with a hull, a deck, at least one outboard motor and a bulwark. The hull includes a rear portion. The deck is provided on the hull. The at least one outboard motor is mounted to the rear portion of the hull. The bulwark is provided on the deck. The deck includes an aft deck in the rear of the deck. The aft deck includes a first part disposed forward of the outboard motor and a second part extending rearward with respect to the first part in a fore-to-aft direction. The first part is at least partially disposed in a non-overlapping location with respect to the outboard motor and the bulwark as viewed from a side view of the outboard motor boat. The second part extends along a lateral portion of the outboard motor.

20 Claims, 22 Drawing Sheets

(51) Int. Cl.

| | |
|---|---|
| ***B63B 29/02*** | (2006.01) |
| ***B63B 29/04*** | (2006.01) |
| ***B63H 20/00*** | (2006.01) |
| ***B63H 20/02*** | (2006.01) |
| ***B63B 17/04*** | (2006.01) |

(52) U.S. Cl.

CPC ..... *B63B 29/04* (2013.01); *B63H 20/02* (2013.01); *B63B 2003/485* (2013.01); *B63B 2017/045* (2013.01); *B63B 2029/022* (2013.01); *B63B 2029/043* (2013.01); *B63H 2020/003* (2013.01)

(56) References Cited

U.S. PATENT DOCUMENTS

| | | | | | |
|---|---|---|---|---|---|
| 3,943,586 | A * | 3/1976 | Palmer | B63B 3/09 | 114/179 |
| 7,607,400 | B2 * | 10/2009 | Scotti | B63B 29/20 | 114/362 |
| 8,826,845 | B2 * | 9/2014 | Mochizuki | B63B 3/48 | 114/362 |
| 9,003,997 | B2 * | 4/2015 | Gratz | B63B 17/00 | 114/362 |
| 9,126,664 | B1 * | 9/2015 | Denson | B63H 20/32 | |
| 9,254,904 | B2 * | 2/2016 | Minoura | B63H 20/245 | |
| 2011/0232557 | A1 * | 9/2011 | Kilgore | B63B 1/08 | 114/271 |

FOREIGN PATENT DOCUMENTS

| | | | | | |
|---|---|---|---|---|---|
| JP | 09207888 | A | * | 8/1997 | |
| JP | 2002019699 | A | * | 1/2002 | B63H 20/10 |
| JP | 2005212705 | A | * | 8/2005 | |
| JP | 2009-208655 | A | | 9/2009 | |
| JP | 2010089609 | A | * | 4/2010 | |
| JP | 2010-254283 | A | | 11/2010 | |

* cited by examiner

WATERCRAFT

BACKGROUND

Field of the Invention

The present invention generally relates to the field of watercrafts.

Background Information

Watercrafts (e.g., boats) are used for many purposes. Often people board the watercraft from the aft deck of the watercraft. Typically, the aft deck of the watercraft is provided with a bulwark, which a person must climb over to get on board the watercraft. Some watercrafts are provided with swimming platforms on the transom to make it easier to get into and out of the watercraft as well as making the watercraft more enjoyable to use.

SUMMARY

Generally, the present disclosure is directed to various features of a watercraft such as an outboard motor boat. However, many features of the disclosed watercraft can be used with other types of watercrafts, and thus are not limited to outboard motor boats.

In accordance with one aspect of the present disclosure, an outboard motor boat is provided that basically comprises a hull, a deck, at least one outboard motor and a bulwark. The hull includes a rear portion. The deck is provided on the hull. The at least one outboard motor is mounted to the rear portion of the hull. The bulwark is provided on the deck. The deck includes an aft deck in the rear of the deck. The aft deck includes a first part and a second part. The first part is disposed forward of the outboard motor. The second part extends rearward with respect to the first part in a fore-to-aft direction. The first part is at least partially disposed in a non-overlapping location with respect to the outboard motor and the bulwark as viewed from a side view of the outboard motor boat. The second part extends along a lateral portion of the outboard motor.

In accordance with another aspect of the present disclosure, an outboard motor boat is provided that basically comprises a hull, a deck, at least one outboard motor and a bulwark. The hull includes a rear portion. The deck is provided on the hull. The at least one outboard motor is mounted to the rear portion of the hull. The bulwark is provided on the deck. The deck includes a mid-deck laterally aligned with the bulwark and an aft deck having a first part disposed between the bulwark and the outboard motor with respect to a fore-to-aft direction. The first part is at least partially disposed in a non-overlapping location with respect to the outboard motor and the bulwark as viewed from a side view of the outboard motor boat. The first part of the aft deck has an upper deck surface that lies either below an upper deck surface of the mid-deck or substantially in a same plane as the upper deck surface of the mid-deck.

In accordance with another aspect of the present disclosure, a watercraft is provided that basically comprises a hull, a deck, at least one propulsion unit, a bulwark and at least one movable seat. The hull includes a rear portion. The deck is provided on the hull. The at least one propulsion unit is provided to propel the watercraft. The bulwark is provided on the deck. The at least one movable seat is movably provided on the deck to move between a first position and a second position. At least a backside portion of the at least one movable seat forms an extended side surface of a rear end of the bulwark while the at least one movable seat is in the first position.

Also other features, aspects and advantages of the disclosed watercraft will become apparent to those skilled in the field of manufacturing watercrafts from the following detailed description, which, taken in conjunction with the annexed drawings, discloses several illustrative embodiments of a watercraft with various features.

BRIEF DESCRIPTION OF THE DRAWINGS

Referring now to the attached drawings which form a part of this original disclosure.

Figure 1:
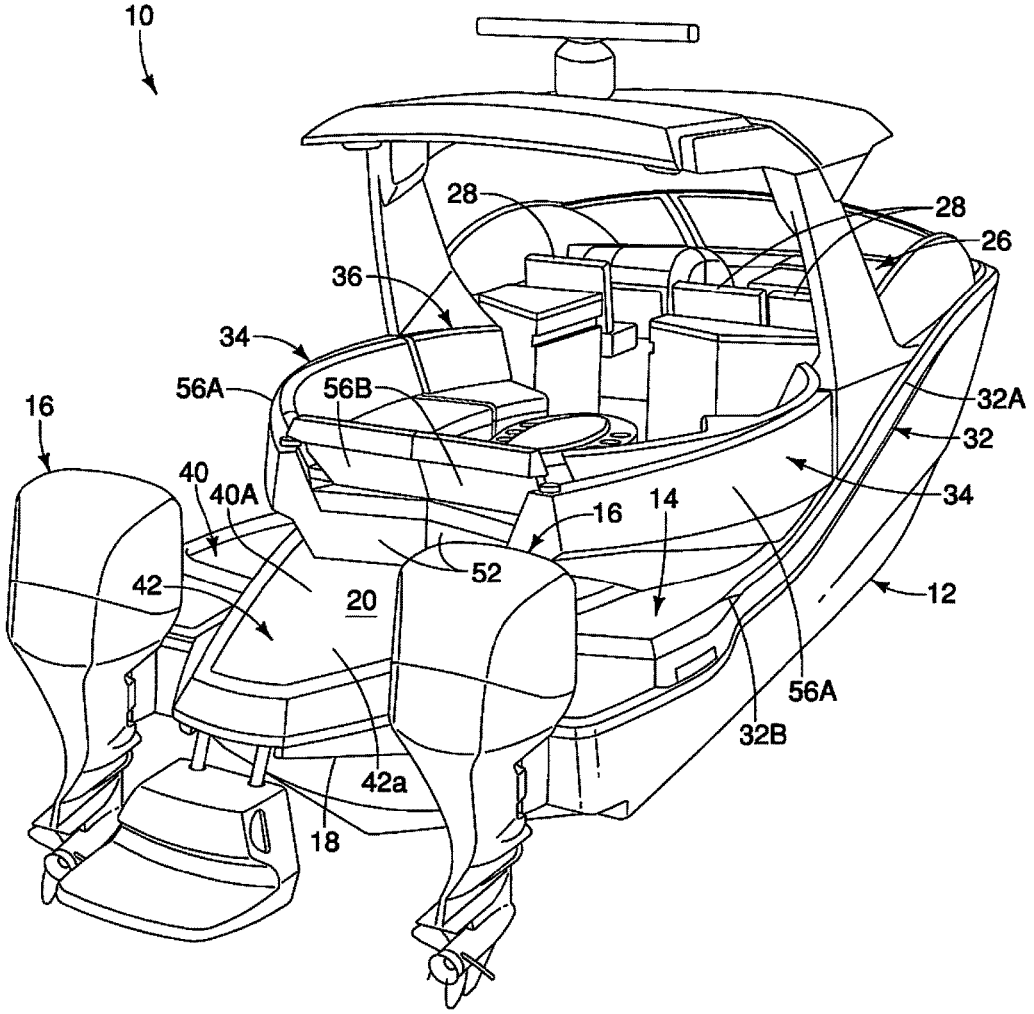
FIG. 1 is a rear perspective view of a watercraft (i.e., an outboard motor boat) in accordance with a first illustrated embodiment, in which the watercraft includes a pair of movable seats in retracted positions and a swimming deck in an in-use position.
Figure 2:
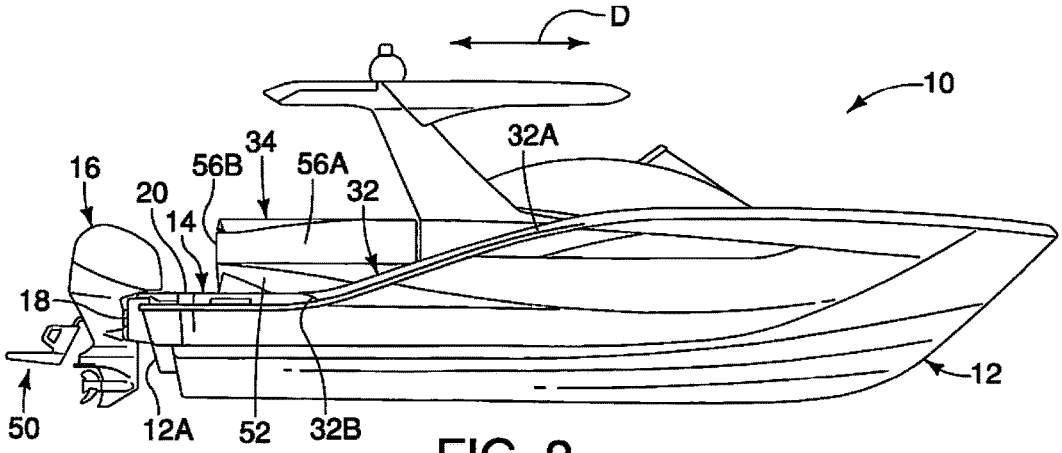
FIG. 2 is a right side (starboard) elevational view of the watercraft illustrated in FIG. 1.
Figure 3:
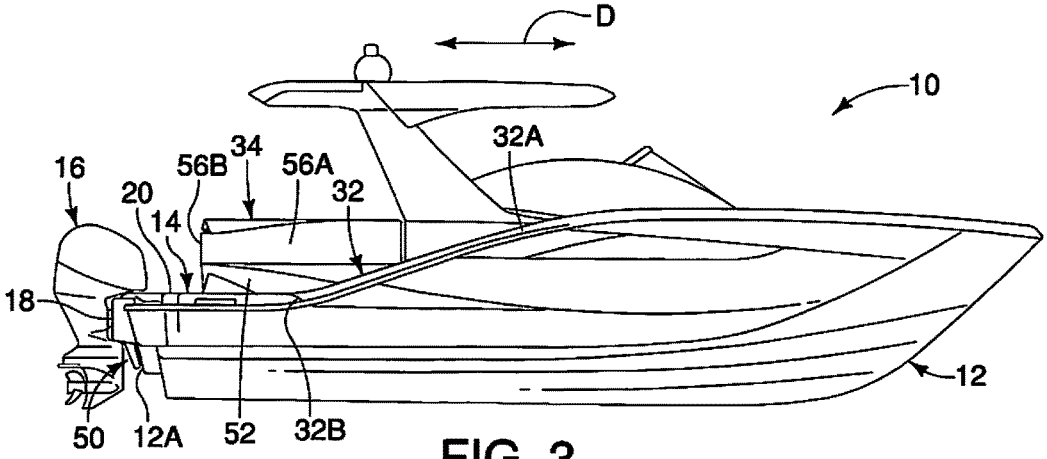
FIG. 3 is a right side (starboard) elevational view, similar to FIG. 2, of the watercraft illustrated in FIG. 1, but with the swimming deck in a stowed position.
Figure 4:
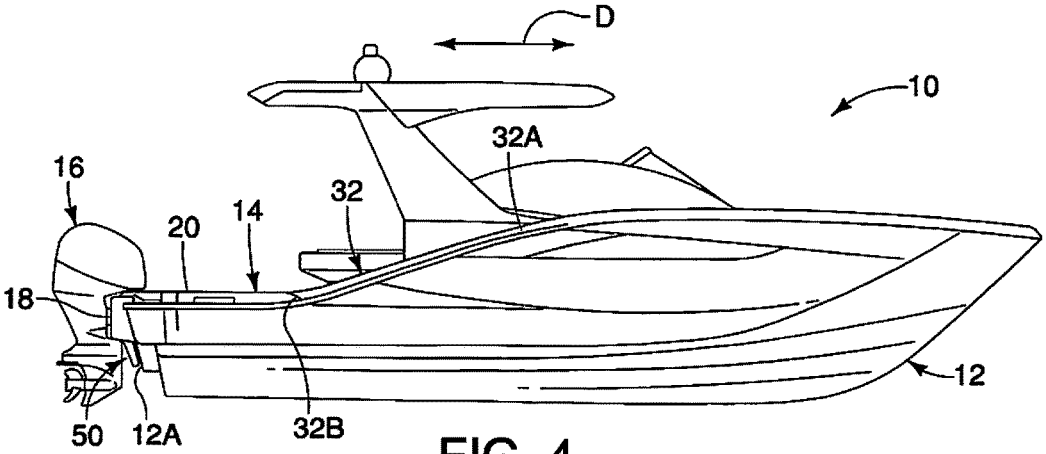
FIG. 4 is a right side (starboard) elevational view, similar to FIG. 3, of the watercraft illustrated in FIG. 1, but with the movable seats removed.

It should be noted that these figures are intended to illustrate the general characteristics of methods, structure and/or materials utilized in certain illustrative embodiments and to supplement the written description provided below. These drawings are not, however, to scale and may not precisely reflect the precise structural or performance characteristics of any given embodiment, and should not be interpreted as defining or limiting the range of values or properties encompassed by illustrative embodiments. The use of similar or identical reference numbers in the various drawings is intended to indicate the presence of a similar or identical element or feature.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents. Like reference numerals in the drawings denote like similar or identical elements or features, and thus the descriptions of the similar or identical elements or features may be omitted in later embodiments.

Referring initially to FIGS. 1 to 15, a watercraft 10 is illustrated in accordance with a first embodiment. As seen in FIG. 1, the watercraft 10 is an outboard motor boat. Basically, the watercraft 10 comprises a hull 12, a deck 14 and at least one propulsion unit 16. The propulsion unit 16 is provided to propel the watercraft 10. In the first embodiment, two of the propulsion units 16 are provided in the form of a pair of outboard motors. However, the watercraft 10 is not limited to this illustrated configuration of the first embodiment. The watercraft 10 can be provided with only a single outboard motor if needed and/or desired depending on the particular design of the watercraft. Also, the watercraft 10 can be provided with one or two other types of propulsion units such as a water-jet drive or an inboard motor. In other words, the unique features of the watercraft 10 can be used with other types of propulsion systems other than the propulsion system illustrated in the first embodiment. In other, at least one propulsion unit or outboard motor is provided or mounted to the rear portion 18 of the hull 12.

In the first embodiment, the hull 12 includes a rear portion 18 (i.e. transom). The propulsion units 16 (i.e., the outboard motors) are mounted to the rear portion 18 of the hull 12. The deck 14 is provided on the hull 12 in a conventional manner. Preferably, the hull 12 and the deck 14 are integrated to form a unit. The hull 12, the deck 14 and the other parts of the watercraft 10 are made of suitable materials that are typically used in watercrafts for a marine environment, and thus the materials of the various parts of the watercraft 10 will not be discussed herein. Here, the deck 14 includes an aft deck 20, a mid-deck 22 and a foredeck 24. The aft deck 20 is located in the rear of the deck 14. The mid-deck 22 is located in the middle of the deck 14 between the aft deck 20 and the foredeck 24. The foredeck 24 is located in the front of the deck 14. The term "aft deck" as used herein refers to a rear part of the deck that is equal to or less than one-third of an entire length of the watercraft. The term "mid-deck" as used herein refers to a middle part of the deck that is at least equal to one-third of an entire length of the watercraft. The term "foredeck" as used herein refers to a front part of the deck that is equal to or less than one-third of an entire length of the watercraft. The mid-deck 22 includes a cockpit 26 that has cockpit seats 28 and a helm console 30. The cockpit 26 is relatively conventional, and thus, will not be discussed in detail herein.

As seen in FIGS. 2, 3 and 5 to 8, the watercraft 10 further comprises a bulwark 32, a pair of (first and second) movable seats 34 and a pair of stationary seats 36. The bulwark 32 is provided on the deck 14, and extends along the lateral sides of the mid-deck 22. Thus, the mid-deck 22 is laterally aligned with the bulwark 32. The bulwark 32 is integrally formed with the deck 14. In other words, the bulwark 32 is a stationary structure that is non-movable with respect to the deck 14. Thus, the bulwark 32 constitutes a stationary bulwark. Here, the bulwark 32 includes a pair of lateral bulwark portions 32A. As each of the lateral bulwark portions 32A approaches toward the aft deck 20, the lateral bulwark portions 32A gradually slope downwardly towards the deck 14. Each of the lateral bulwark portions 32A has a rear end 32B converging with an upper deck surface 22A of the mid-deck 22. Thus, the lateral bulwark portions 32A terminate prior to the aft deck 20. Thus, the bulwark 32 does not extend along the lateral sides of the aft deck 20. The bulwark 32 does not extend laterally across the aft deck 20. Rather, as explained below, the movable seats 34 are configured and arranged to form a movable bulwark. As a result of this configuration of the bulwark 32 and the movable seats 34, the deck 14 can be easily accessed from the aft deck 20 without stepping over the bulwark 32.

In the first embodiment, the aft deck 20 is substantially equal to one-quarter of the deck 14. The aft deck 20 has a T-shaped configuration as viewed from a top plan view. In the watercraft 10, the aft deck 20 is disposed between the bulwark 32 and the propulsion units 16. The aft deck 20 includes a first part 40 having an upper deck surface 40A and a second part 42 having an upper deck surface 42A. The upper deck surface 42A of the second part 42 of the aft deck 20 lies either below the upper deck surface 40A of the first part 40 of the aft deck 20, or substantially in a same plane as the upper deck surface 40A of the first part 40 of the aft deck 20. The phrase "substantially in a same plane" as used herein refers to the surfaces being either even or deviate ±one hundred millimeters from the same plane, or more preferably ±twenty-five millimeters from the same plane. Here, the upper deck surfaces 40A and 42A are illustrated in the same plane. In this way, a person can freely walk between the first and second parts 40 and 42 of the aft deck 20 without having to step over a bulwark or the like. In the case that the upper deck surface 42A of the second part 42 of the aft deck 20 lies below the upper deck surface 40A of the first part 40 of the aft deck 20, a gap is created between the upper deck surface 42A of the second part 42 of the aft deck 20 and the upper deck surface 40A of the first part 40 of the aft deck 20. In this case, the height of the gap can be equal to or less than one hundred millimeter.

The first part 40 is disposed forward of the propulsion units 16 (i.e., the outboard motors in the first embodiment). Specifically, the first part 40 is disposed between the bulwark 32 and the propulsion units 16 with respect to a fore-to-aft direction D of the watercraft 10. As seen in FIGS. 2 to 5, the first part 40 of the aft deck 20 is at least partially disposed in a non-overlapping location with respect to the propulsion units 16 (i.e., the outboard motors) and the bulwark 32 as viewed from a side elevational view of the watercraft 10. In the first embodiment, the first part 40 of the aft deck 20 does not overlap with the propulsion units 16 as viewed from a side elevational view of the watercraft 10. Likewise, in the first embodiment, the first part 40 of the aft deck 20 does not overlap with the bulwark 32 as viewed from a side elevational view of the watercraft 10. The upper deck surface 40A of the first part 40 of the aft deck 20 lies either below an upper deck surface 22A of the mid-deck 22, or substantially in a same plane as the upper deck surface 22A of the mid-deck 22. Here, the upper deck surfaces 22A and 40A are illustrated in the same plane. In the case that the upper deck surface 40A of the first part 40 of the aft deck 20 lies below the upper deck surface 22A of the mid-deck 22, a gap is created between the upper deck surface 40A of the first part 40 of the aft deck 20 and the upper deck surface 22A of the mid-deck 22. In this case, the height of the gap can be equal to or less than one hundred millimeter.

The second part 42 extends rearward with respect to the first part 40 in the fore-to-aft direction D of the watercraft 10. In the first embodiment, the second part 42 of the aft deck 20 extends between the propulsion units 16. Also as seen in FIGS. 2 to 5, the second part 42 of the aft deck 20 extends along a lateral portion of the propulsion units 16. The second part 42 of the aft deck 20 has a shape that is spaced away from the propulsion units 16 as moving rearward so as not to interfere with the propulsion units 16 while steering the propulsion units 16. In particular as illustrated in the first embodiment, the second part 42 of the aft deck 20 extends into an area A that is located laterally between the propulsion units 16. In the case of the propulsion units 16 being outboard motors, the second part 42 of the aft deck 20 is configured to become narrower as the second part 42 of the aft deck 20 extends rearward in the fore-to-aft direction D between the propulsion units 16.

Figure 11:
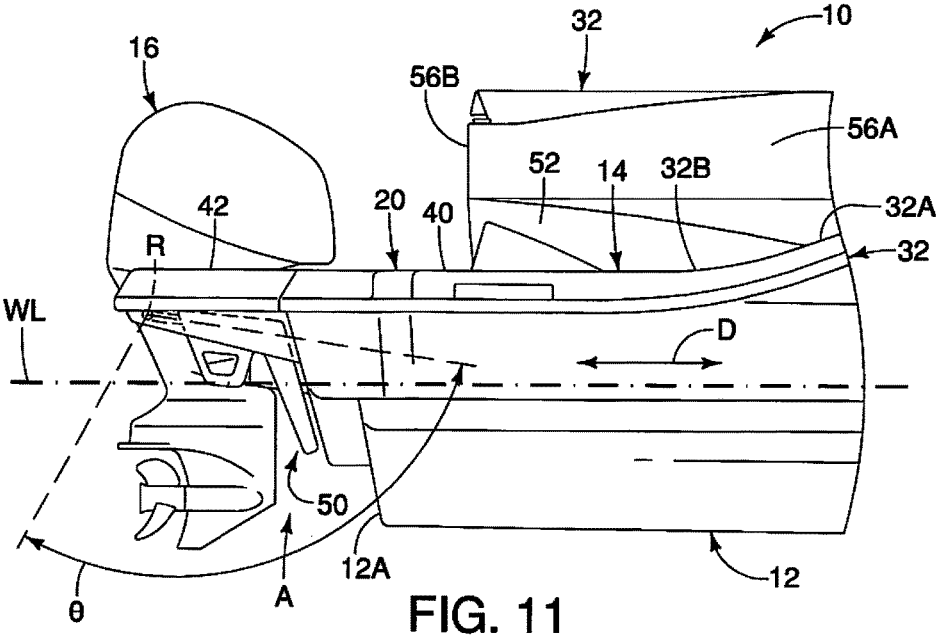
FIG. 11 is a partial right side (starboard) elevational view, similar to FIG. 2, of the watercraft illustrated in FIGS. 1 to 10, with the swimming deck in a stowed position.

As seen in FIGS. 1 to 3 and 6 to 11, the watercraft 10 further comprises a swimming deck 50. The swimming deck 50 is pivotally mounted to the aft deck 20 between an in-use position (FIGS. 1, 2, 7, 8 and 10) and a stowed position (FIGS. 3, 6, 9 and 11) about a pivot axis R. As seen in FIG. 11, the swimming deck 50 has a pivot angle θ of 110 degrees. However, depending on the configuration of the swimming deck 50 and the hull 12, the pivot angle θ can be in a range of 100 degrees to 120 degrees. As seen in FIGS. 3, 6, 9 and 11, the swimming deck 50 is disposed underneath the second part 42 of the aft deck 20 while in the stowed position. As seen in FIGS. 1, 2, 7, 8 and 10, the swimming deck 50 is disposed rearward of the aft deck 20 while in the in-use position.

The swimming deck 50 including at least one step 50A above a water line WL of the hull 12 and at least one step 50B under the water line WL of the hull 12 while the watercraft 10 is unloaded and/or loaded within a load capacity rating for the watercraft 10. The swimming deck 50 can have more steps as needed and/or desired depending on the hull design. The steps 50A and 50B are substantially parallel to the upper deck surface 42A of the second part 42 of the aft deck 20 while in the in-use position, and substantially parallel to a rear face 12A of the hull 12 while in the stowed position. The phrase "substantially parallel" as used herein includes parallel and ±ten degrees from parallel. The steps 50A and 50B are supported by a frame 50C. Here, the steps 50A and 50B are illustrated as being parallel. The steps 50A and 50B can be either molded onto the frame 50C as illustrated or fixed to the frame 50C by fasteners. The frame 50C preferably includes a locking arrangement that engages a support member (not shown) of the aft deck 20 for selectively locking the swimming deck 50 in the stowed position and for selectively locking the swimming deck 50 in the in-use position. Since the locking arrangement can be any suitable type of locking arrangement, the specifics of the locking arrangement for the swimming deck 50 will not be discussed in detail herein.

Turning now to FIGS. 5 to 8, the movable seats 34 will now be discussed in more detail. The movable seats 34 are bench seats that each accommodates one or more occupants. Preferably, the movable seats 34 are sized to comfortably seat at least three average size adults. The movable seats 34 are generally L-shaped and mirror images of each other. In other words, each of the movable seats 34 has a first seating section 34A and a second seating section 34B. The first seating section 34A extends mainly in fore-to-aft direction D while the movable seat 34 is in the first position. The second seating section 34B extends mainly in a lateral direction L while the movable seat 34 is in the first position.

Each of the movable seats 34 includes a base 52 and a seat cushion 54. The bases 52 are movably supported on the deck 14 as explained below. Each of the bases 52 has a backside portion 56. Since the bases 52 are generally L-shaped members, each of the backside portions 56 has a lateral facing section 56A and a rearward facing section 56B. Each of the lateral facing sections 56A constitutes a lateral bulwark portion, while the rearward facing sections 56B constitute a rear bulwark portion. In other words, the lateral facing sections 56A and the rearward facing sections 56B are configured and arranged with respect to the bulwark 32 to form a movable bulwark. Alternatively, the movable seats 34 can be configured such that rear end portions of the movable seats 34 do not meet together while the movable seats 34 are in the second position if needed and/or desired. In this way, the mid-deck space B can be easily accessed while the movable seats 34 are in either the first position or the second position.

As seen in FIGS. 12 to 15, in the first embodiment, the watercraft 10 has a pair of support mechanisms 58 (only one shown) for movably supporting the bases 52 of the movable seats 34 on the deck 14. Thus, one of the support mechanisms 58 is fixed to the bottom of each of the movable seats 34. The support mechanisms 58 are identical to each other except that they are mirror images, and thus, only one of the support mechanisms 58 will be illustrated in the drawings. Basically, each of the support mechanisms 58 includes a support plate or member 60, a plurality of support posts 62 and a plurality of rollers 64. The support plate 60 is fixed to the bottom the movable seat 34 such that the support plate 60 can be considered a part of the movable seat 34. As explained below, the rollers 64 are fixed to the support plate 60 to movably support the support plate 60 on the deck 14, while the support posts 62 are fixed to the deck 14 and engage the support plate 60 to guide the support plate 60 as the support plate 60 moves along the deck 14. The support posts 62 are preferably all identical as shown, but be different if needed and/or desired. The rollers 64 are preferably all identical as shown, but be different if needed and/or desired.

Each of the movable seats 34 has a bracket 66 (only one shown) that is rigidly attached to a front end of each of the support plate 60. The bracket 66 is pivotally attached to the deck 14 to pivot about a pivot axis P. Thus, each of the movable seats 34 is pivotally mounted to the deck 14 to pivot about the pivot axis P. An actuator 68 (only one shown) is connected to each of the brackets 66 for pivoting the brackets 66 about the pivot axis P, and thus, also for pivoting the movable seat 34 about the pivot axis P. It will be apparent of this disclosure that the actuator 68 can be any suitable type of actuator such as an electric screw actuator, a hydraulic actuator, a pneumatic actuator, etc. Alternatively, the movable seats 34 can be manually moved.

Figure 12:
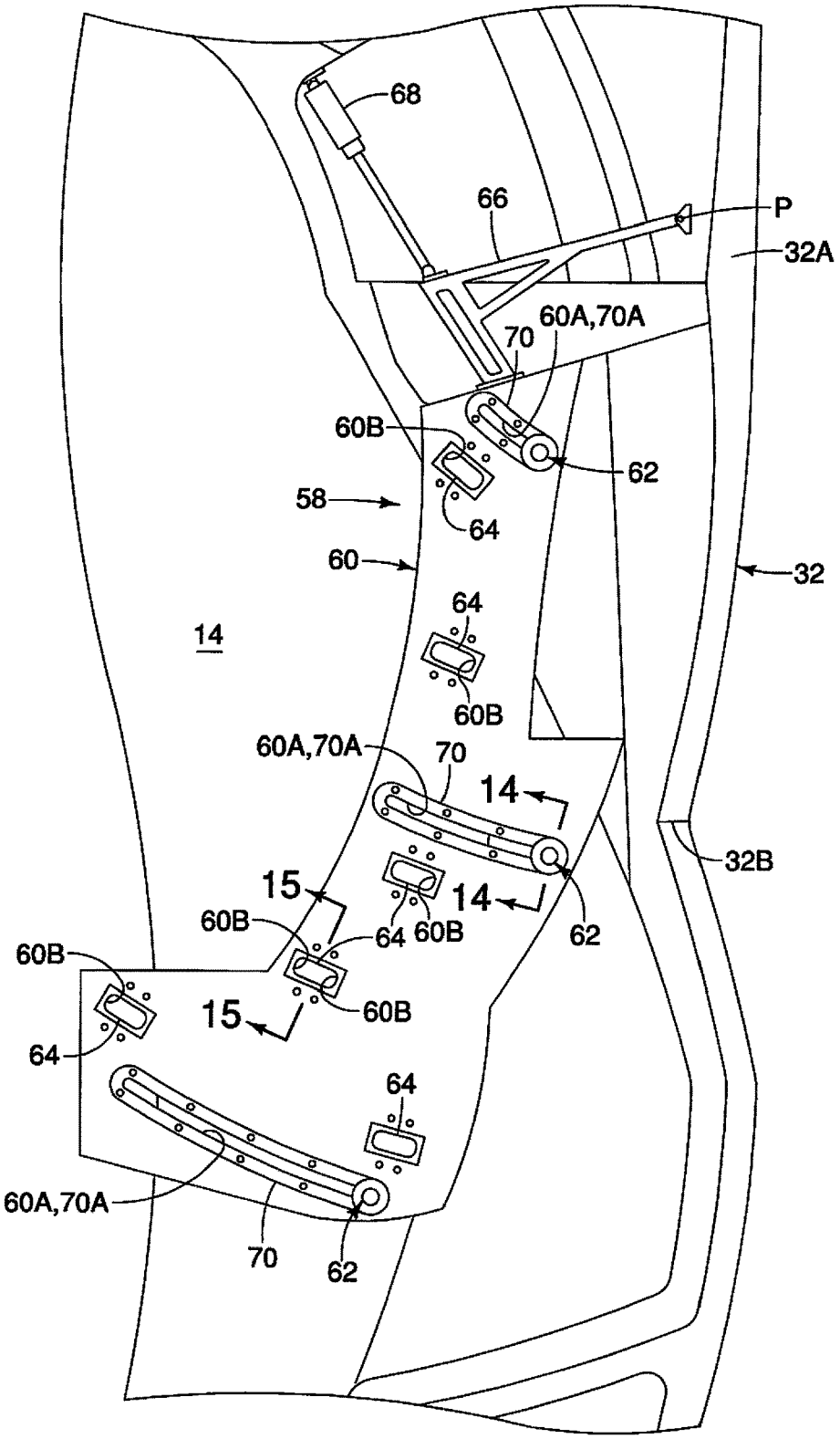
FIG. 12 is a partial top plan view of a support mechanism and an actuation structure for one of the movable seats of the watercraft illustrated in FIGS. 1 to 11, with the support mechanism and the actuation structure in the retracted positions.
Figure 13:
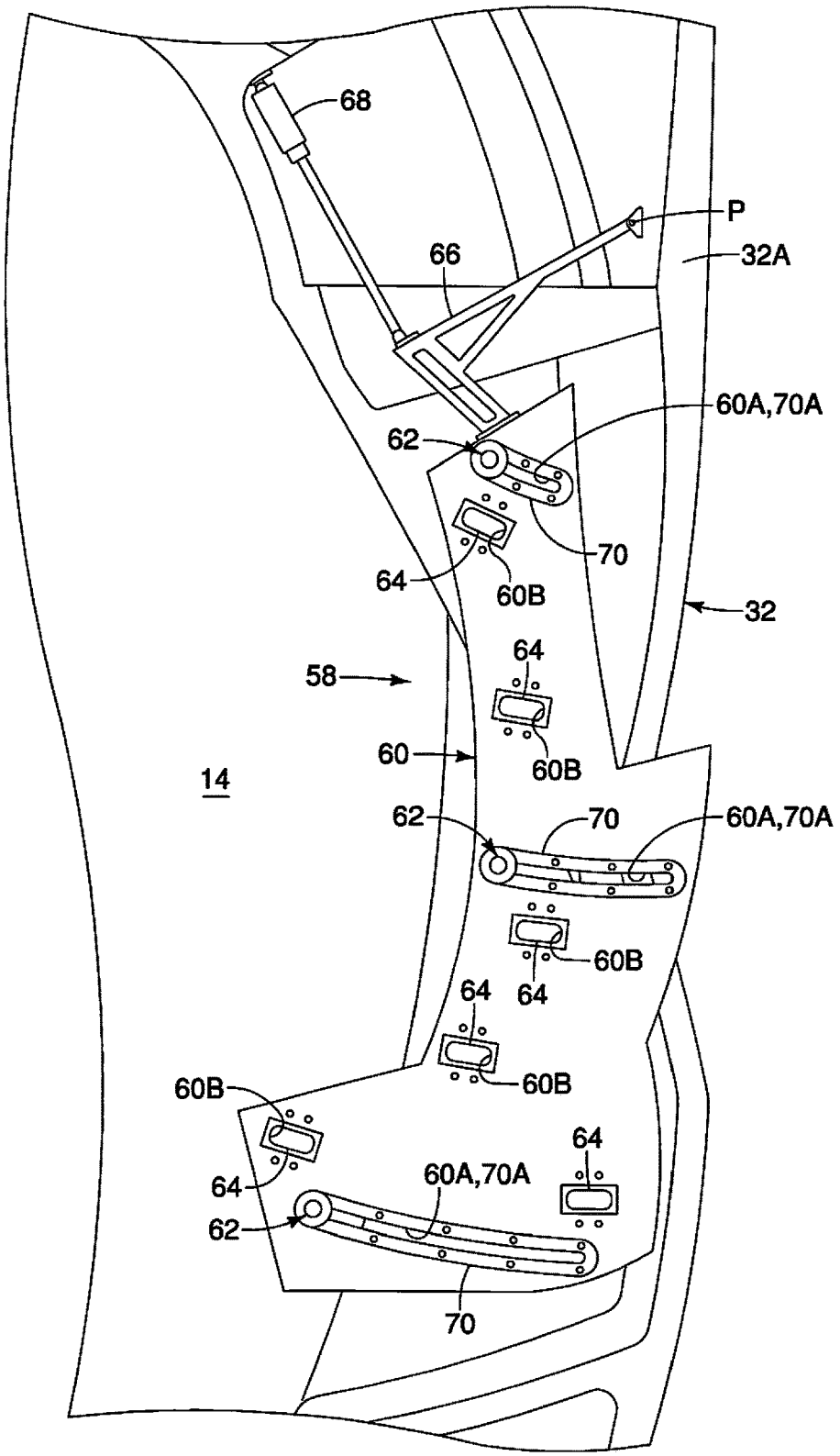
FIG. 13 is a partial top plan view, similar to FIG. 12, of the support mechanism and the actuation structure for one of the movable seats of the watercraft illustrated in FIGS. 1 to 11, with the support mechanism and the actuation structure in the extended positions.

As seen in FIGS. 12 and 13, in the first embodiment, the support plate 60 is basically a flat rigid plate. The support plate 60 has a plurality of curved guide slots 60A and a plurality of openings 60B. The curved guide slots 60A are arranged to slidably engage the support posts 62A, while the openings 60B are configured to support the rollers 64 therein as explained below.

A curved reinforcement plate 70 is attached to the upper and lower surfaces of the support plate 60 at each of the curved guide slots 60A. The curved reinforcement plates 70 are flat rigid members. Each of the curved reinforcement plates 70 has a curved guide slot 70A that aligns with the curved guide slots 60A for receiving the support posts 62 therethrough. Each of the curved guide slots 60A and 70A is orientated such that each of their curvatures has a center of curvature located at the pivot axis P to the extent permitted by manufacturing tolerances.

Figure 14:
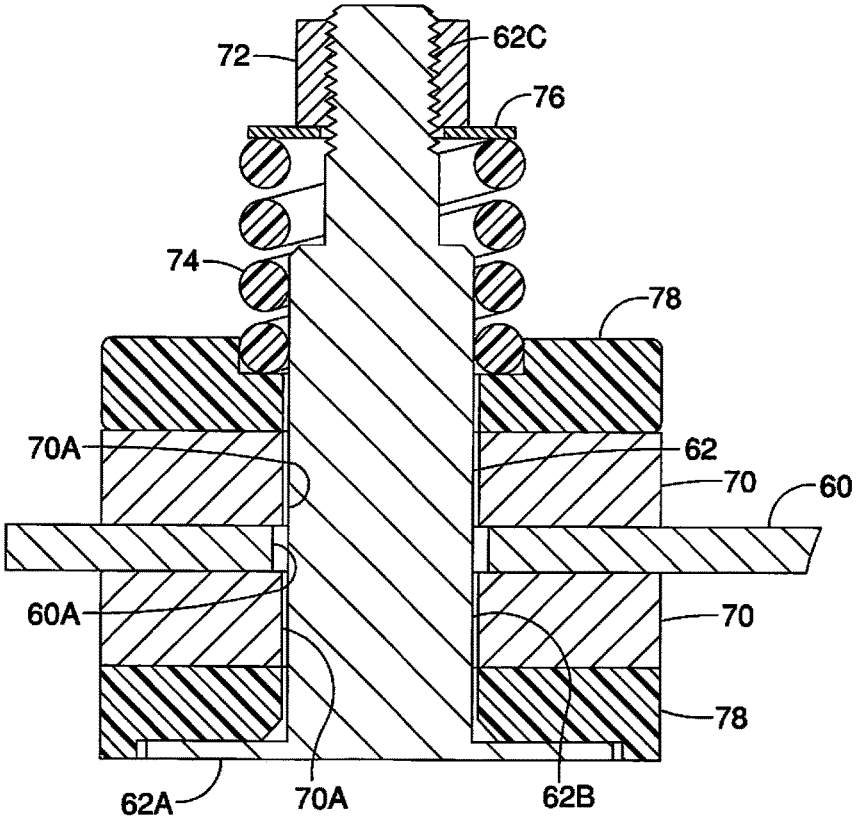
FIG. 14 is a partial cross sectional view of the right movable seat support as seen along section line 14-14 of FIG. 12 showing one of the guide arrangements of the support mechanism for the right movable seat of the watercraft illustrated in FIGS. 1 to 11.

As seen in FIG. 14, the support posts 62 (only one shown) are fixed to the deck 14 so as to project outwardly from the upper surface of the deck 14. The support posts 62 are rigid members. The support posts 62 are rigidly fixed to the deck 14 using suitable fasteners (not shown) at locations corresponding to the curved guide slots 60A and 70A. Each of the support posts 62 has a head portion 62A, a guide portion 62B and a threaded shaft portion 62C. The head portions 62A are rigidly fixed to the deck 14 using suitable fasteners (not shown). The guide portion 62B is a smooth shaft that is disposed in the curved guide slots 60A and 70A. The head portion 62A is located at the lower end of the guide portion 62B, while the threaded shaft portion 62C is located at the upper end of the guide portion 62B. A nut 72 is screwed onto the threaded shaft portion 62C of the support post 62. Preferably, a polyurethane die spring 74 and a washer 76 are provided on each of the support posts 62 for allowing the support plate 60 to slide relative to the support posts 62 and to take up any play between the support plate 60 and the support posts 62. The polyurethane die springs 74 also load the threads of the nuts 72 and the threaded shaft portions 62C for preventing the nuts 72 from inadvertently loosening. Preferably, each of the support posts 62A is provided with a pair of low friction bushings 78 to aid in smooth sliding of the support plate 60 relative to the support posts 62.

Figure 15:
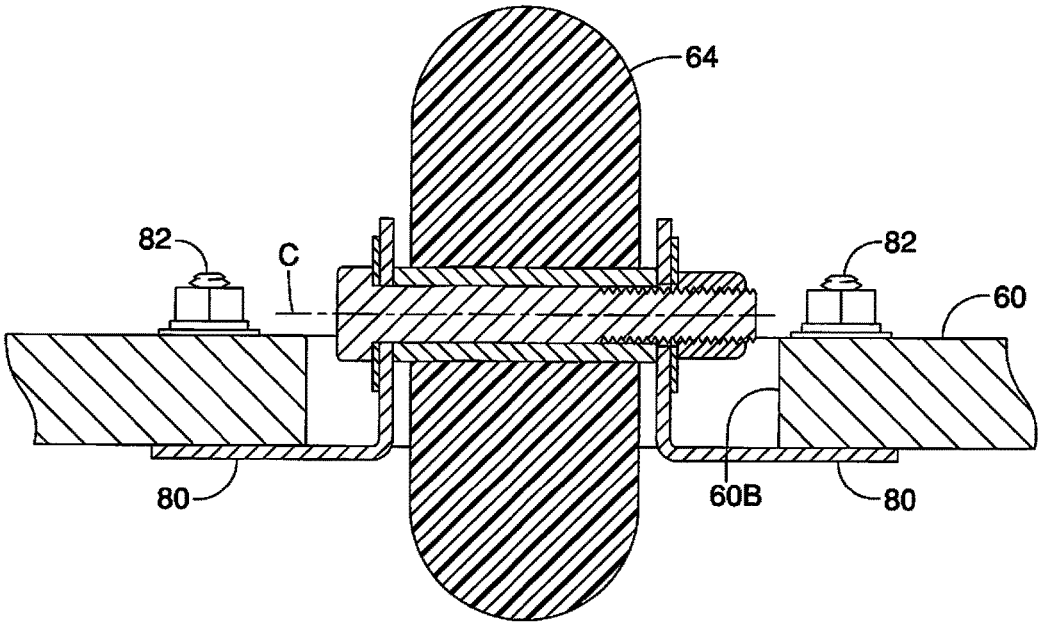
FIG. 15 is a partial cross sectional view of the right movable seat support as seen along section line 15-15 of FIG. 12 showing one of the roller arrangements of the support mechanism for the right movable seat of the watercraft illustrated in FIGS. 1 to 11.

As seen in FIG. 15, the rollers 64 (only one shown) are supported in the openings 60B of the support plate 60. In particular, each of the rollers 64 is mounted to the support plate 60 by a pair of support brackets 80 and a fastener 82 (i.e., a nut and bolt). In the first embodiment, the rollers 64 are supported in the openings 60B such that rotational axes C of the rollers 64 are located above the bottom surface of the support plate 60 as seen in FIG. 15. Thus, only a small portion of each of the rollers 64 protrudes from the bottom surface of the support plate 60. In this way, the gap between the bottom surface of the support plate 60 and the upper surface of the deck 14 can be minimized.

Referring back to FIGS. 5 to 8, each of the movable seats 34 are movably provided on the deck 14 to move between a first position (FIGS. 5 and 6) and a second position (FIGS. 7 and 8). As mentioned above, the movable seats 34 are each pivotally mounted to pivot about the pivot axis P as the movable seat 34 moves between the first position and the second position. In the first embodiment, the first position of each of the movable seats 34 corresponds to a retracted position or a non-access position, while the second position of each of the movable seats 34 corresponds to an extended position or an access position. As seen in FIGS. 12 and 13, the actuators 68 (only one shown) are provided to selectively and independently move the movable seats 34 between the first position and the second position. Each actuator 68 is operatively connected to the helm console 30 for operation by a user. Preferably, the helm console 30 is set up so that the user can selectively move either one of the movable seats 34 by itself, or both of the movable seats 34 simultaneously as desired.

Figure 5:
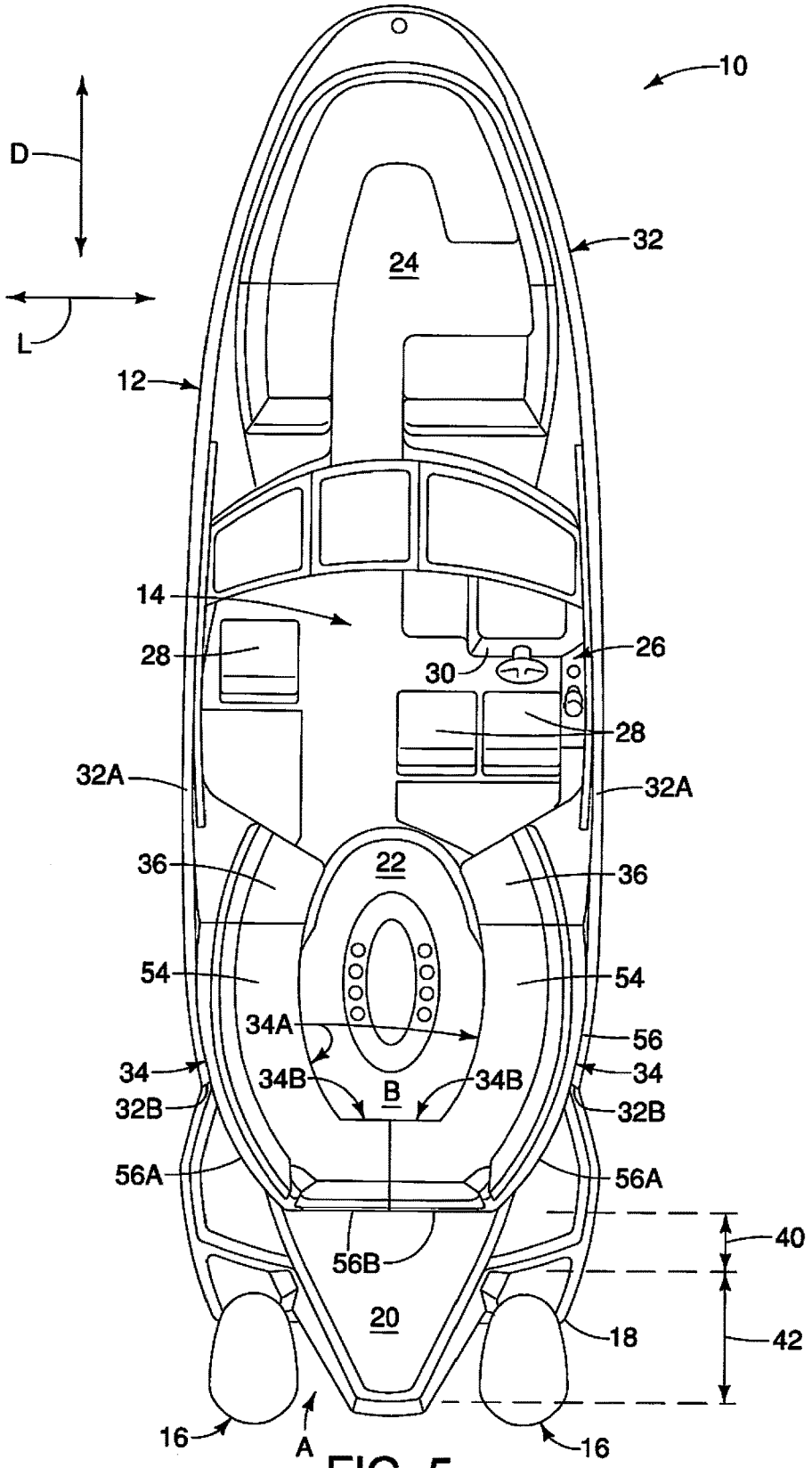
FIG. 5 is a top plan view of the watercraft illustrated in FIGS. 1 to 4, with the movable seats in the retracted positions and the swimming deck in the stowed position.
Figure 6:
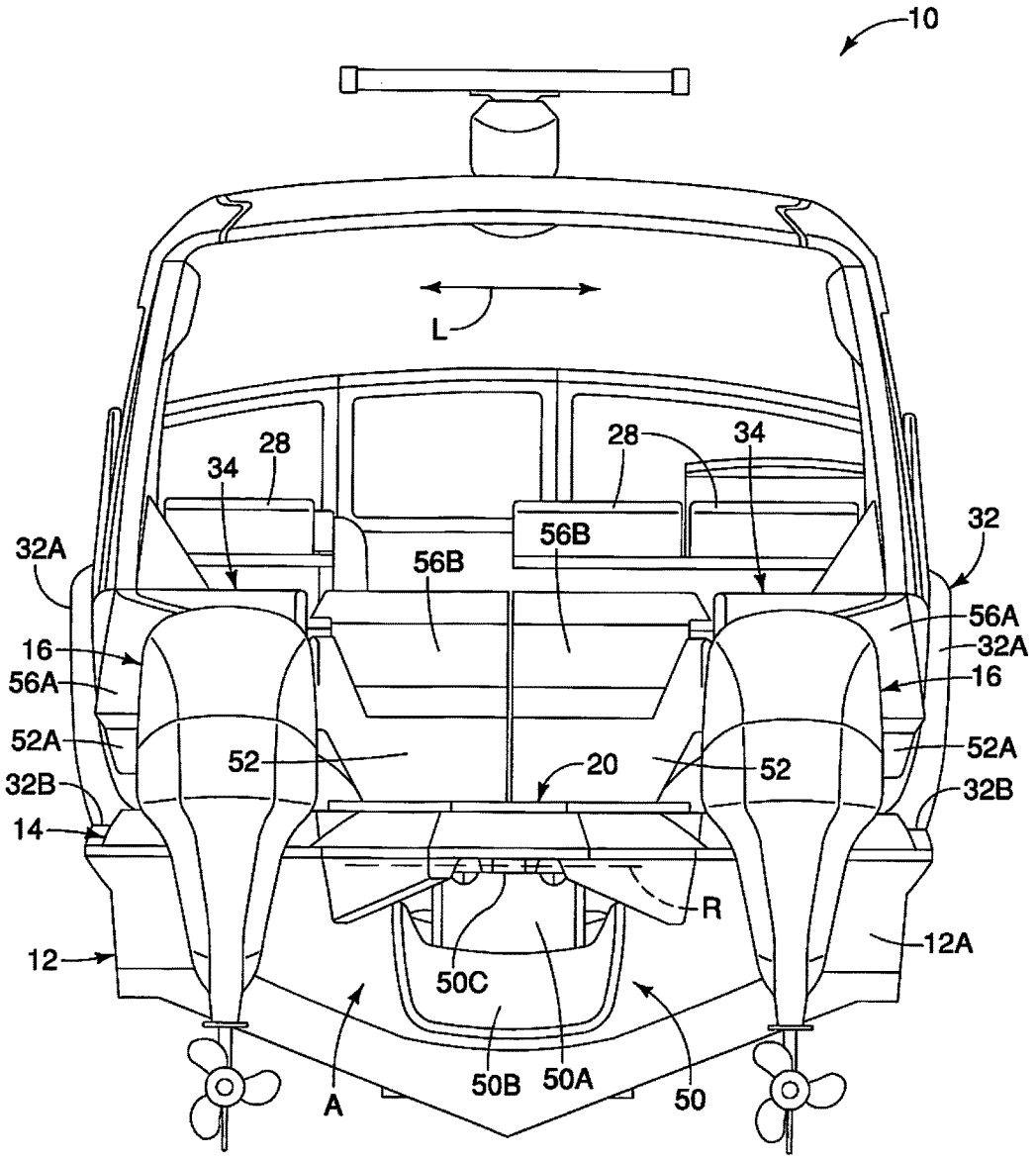
FIG. 6 is a rear end (stern) elevational view of the watercraft illustrated in FIGS. 1 to 5, with the movable seats in the retracted positions and the swimming deck in the stowed position.

As mentioned above, the bulwark 32 constitutes a stationary bulwark, while the backside portions 56 of the movable seats 34 constitutes a movable bulwark. In particular, the lateral facing sections 56A of the movable seats 34 act as an extension of the lateral bulwark portions 32A of the bulwark 32, while the rearward facing sections 56B of the movable seats 34 act as the rear bulwark portion. As seen in FIGS. 5 and 6, while the movable seats 34 are in the first position, at least the lateral facing sections 56A of the backside portions 56 form extended side surfaces of the rear end 32B of the lateral bulwark portions 32A of the bulwark 32. In other words, the lateral facing sections 56A define extended side surfaces that extend from the rear ends 32B of the lateral bulwark portions 32A of the bulwark 32 so that the interior area between the movable seats 34 is inaccessible from the lateral sides of the watercraft 10 without climbing over the movable seats 34. Also a rear portion of the bulwark of the watercraft 10 includes the movable seats 34 in that the backside portions 56 forms a rear bulwark portion of the watercraft 10. In the first embodiment, the backside portions 52A of the bases 52 of the movable seats 34 are offset towards the center of the watercraft 10 with respect to the lateral bulwark portions 32A of the bulwark 32 as seen in FIG. 6.

Further while the movable seat 34 is in the first position, the movable seats 34 and the stationary seats 36 on each side of the mid-deck 22 are positioned to form a pair of continuous bench seats. The movable seats 34 are arranged laterally with respect to each other and have seating directions that substantially face each other while the first and second movable seats 34 are in the first position. Also, while the movable seats 34 are in the first position, the aft deck 20 and the mid-deck 22 are separated from each with the movable seats 34 acting as a barrier or a movable bulwark. The movable seats 34 extend along a rear side of a mid-deck space B of the deck 14 while the movable seat 34 is in the first position, and the movable seat 34 opens access to the mid-deck space B of the deck 14 upon movement of the movable seat 34 from the first position towards the second position. The movable seats 34 are arranged laterally with respect to each other and have seating directions that substantially face each other while the first and second movable seats 34 are in the second position.

Figure 7:
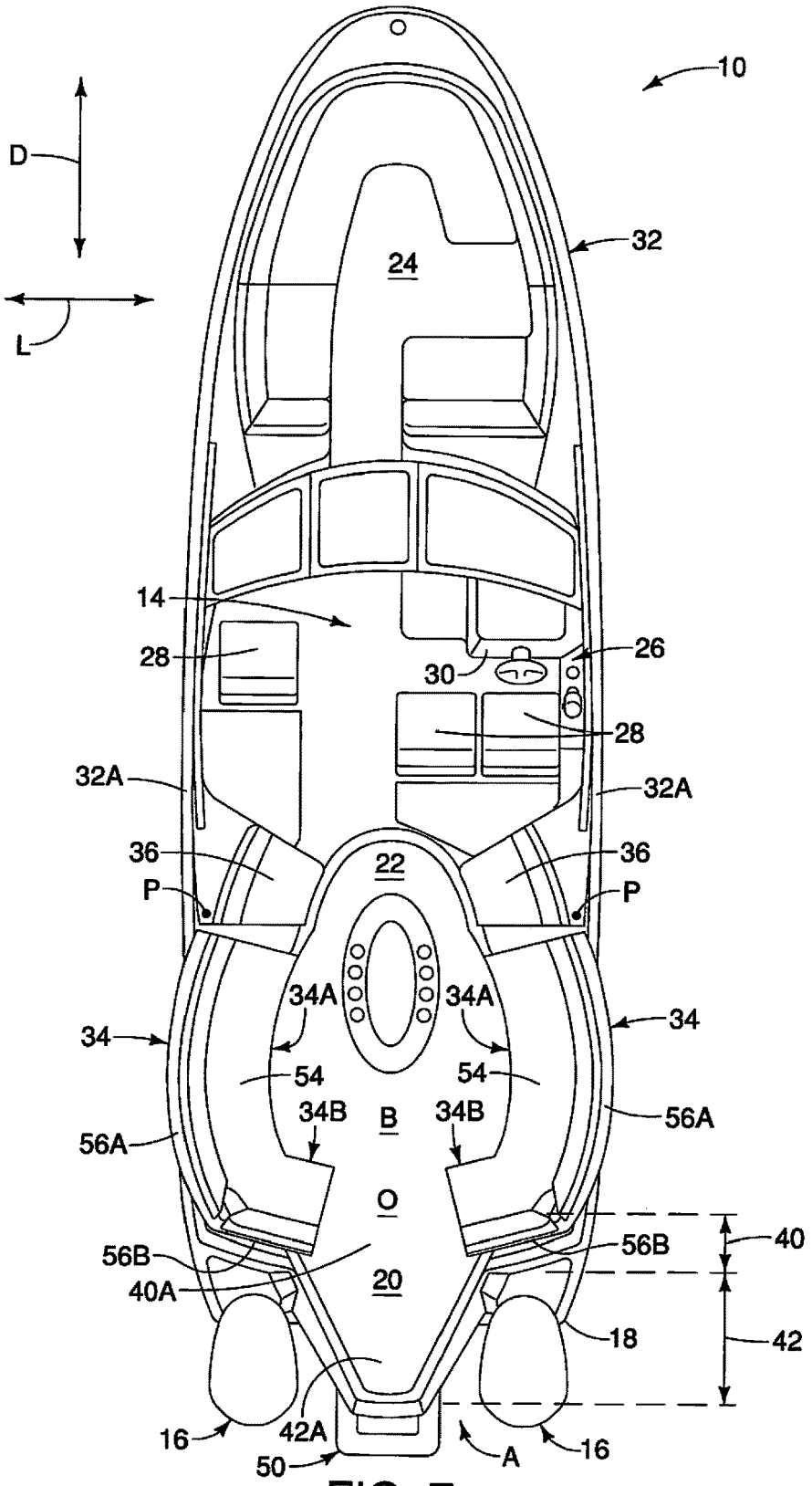
FIG. 7 is a top plan view of the watercraft illustrated in FIGS. 1 to 6, with the movable seats in the retracted positions and the swimming deck in the in-use position.
Figure 8:
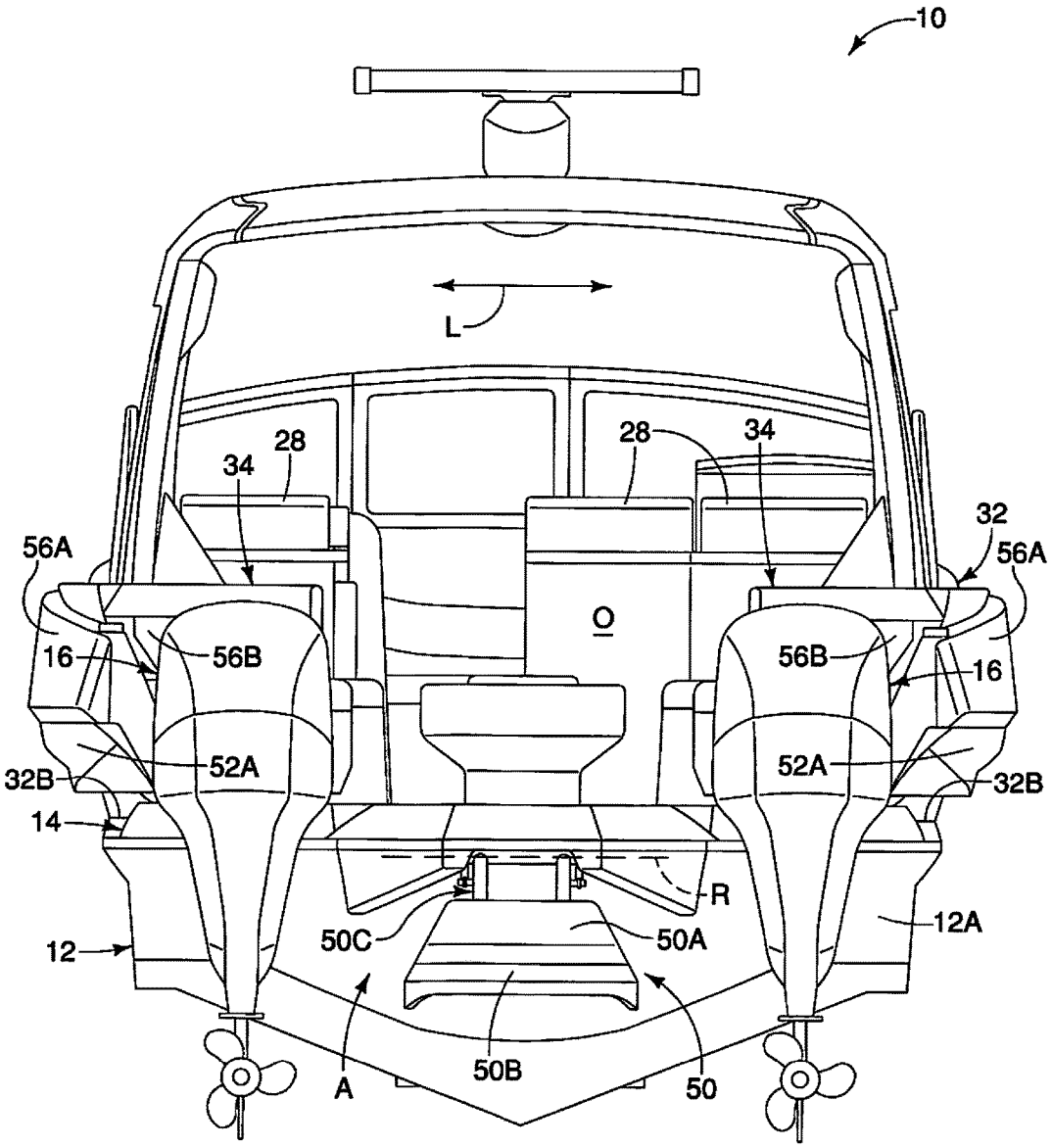
FIG. 8 is a rear end (stern) elevational view of the watercraft illustrated in FIGS. 1 to 7, with the movable seats in the extended positions and the swimming deck in the in-use position.
Figure 9:
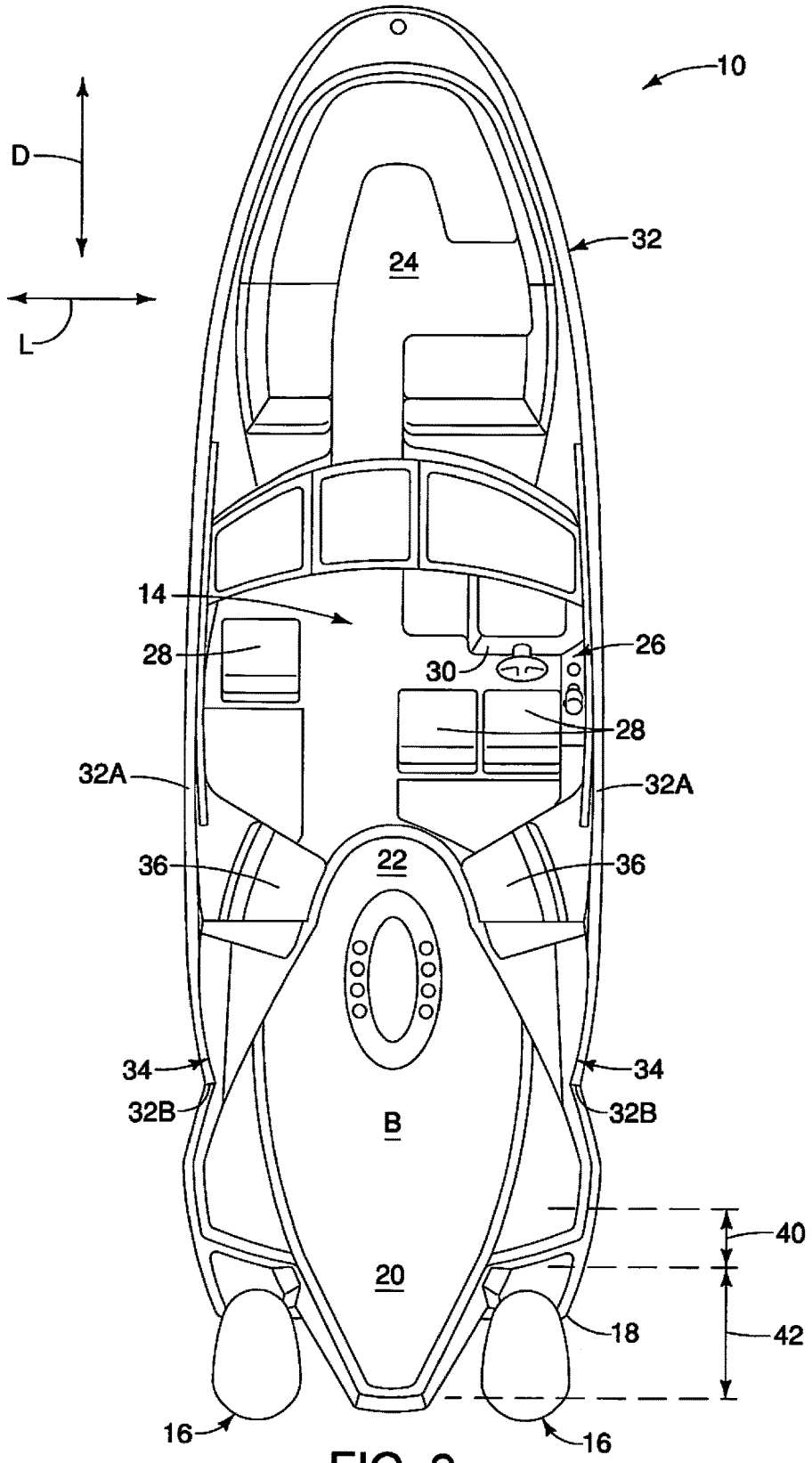
FIG. 9 is a top plan view of the watercraft illustrated in FIGS. 1 to 8, with the movable seats removed and the swimming deck in the stowed position.
Figure 10:
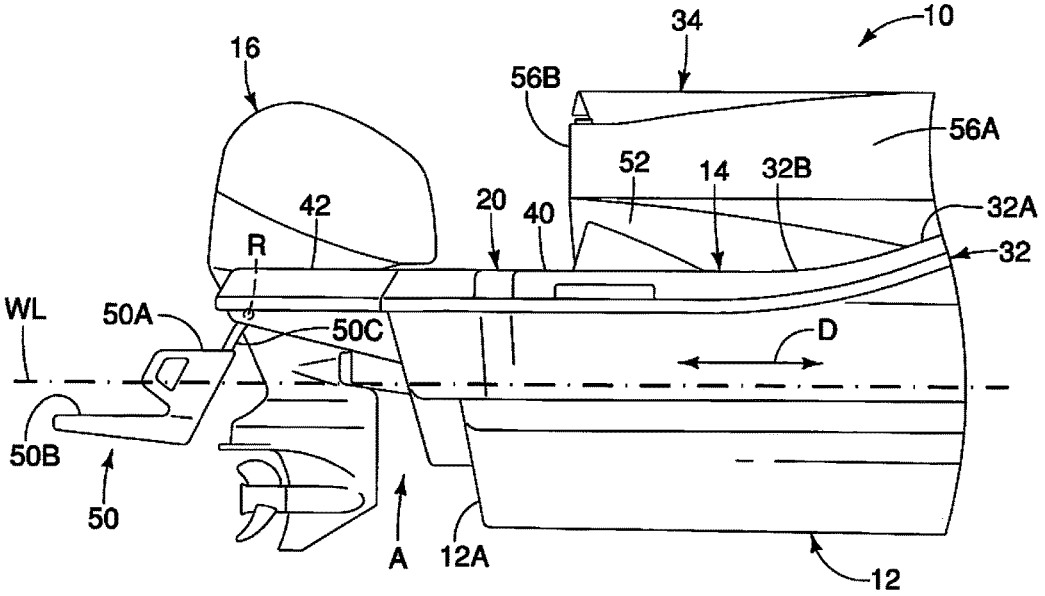
FIG. 10 is a partial right side (starboard) elevational view of the watercraft illustrated in FIGS. 1 to 9, with the swimming deck in the in-use position.

As seen in FIGS. 7 and 8, while the movable seats 34 are in the second position, an access opening or space O is formed between the aft deck 20 and the mid-deck 22 such that unfettered access is provided between the aft deck 20 and the mid-deck 22. Also as seen in FIG. 7, the rear portions (i.e., a part of the backside portion 52A) of the movable seats 34 extend over a lateral end area of the aft deck 20 that is laterally outward of the rear ends 32B of the bulwark 32 while the movable seats 34 are in the second position. In other words, the movable seats 34 at least partially protrude outward relative to a front section of the bulwark 32 upon movement of the movable seat 34 from the first position towards the second position.

Figure 16:
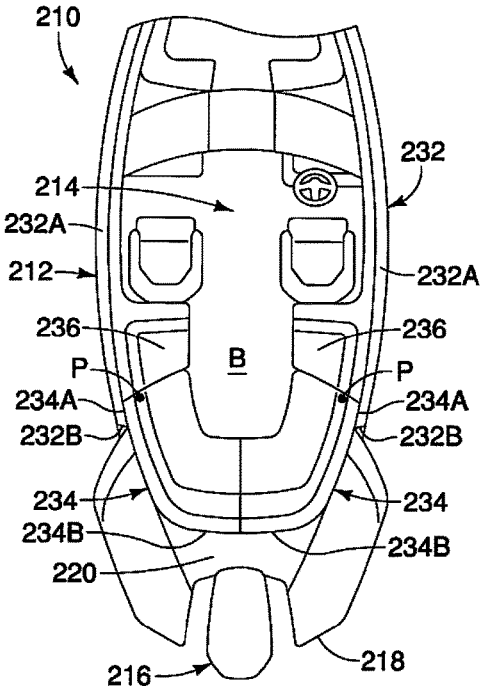
FIG. 16 is a partial top plan view of a watercraft (i.e., an outboard motor boat) in accordance with a second illustrated embodiment, with a pair of movable seats in retracted positions (interior facing positions)
Figure 17:
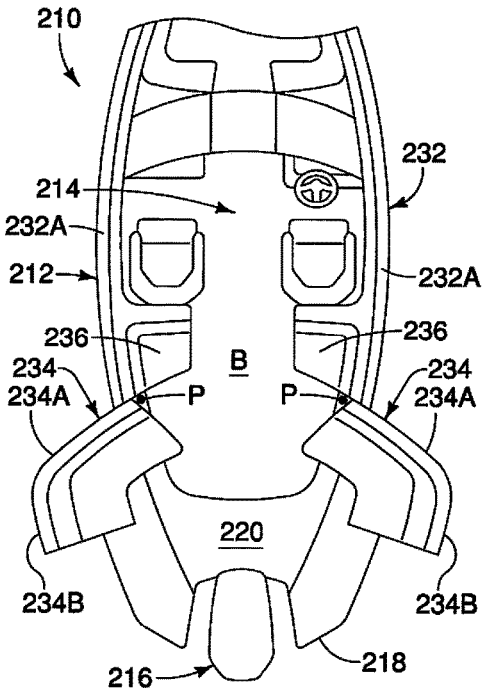
FIG. 17 is a partial top plan view of the watercraft illustrated in FIG. 16, with the movable seats in the extended positions (water facing positions)

Referring now to FIGS. 16 and 17, a watercraft 210 is illustrated in accordance with a second embodiment. Basically, the watercraft 210 comprises a hull 212, a deck 214 and a single propulsion unit 216 (i.e., an outboard motor). Here, in the second embodiment, the watercraft 210 is an outboard motor boat in which the hull 212 has a rear portion 218 that is configured for the single propulsion unit 216. The deck 214 includes an aft deck 220 that is freely accessible from the lateral sides of the watercraft 210. The watercraft 210 further comprises a bulwark 232, a pair of movable seats 234 and a pair of stationary seats 236. The bulwark 232 is identical to the bulwark 32 as discussed above. Thus, the bulwark 232 has a pair of lateral bulwark portions 232A that do not extend along the aft deck 220 and the movable seats 234 form a movable bulwark that extends from rear ends 232B of the bulwark 232 and then laterally across the watercraft 210.

Here, the movable seats 234 are movably mounted on the deck 214 to move between a first or retracted position (FIG. 16) and a second or extended position (FIG. 17). Here, each of the movable seats 234 includes a front portion 234A having a pivot axis P, and a rear portion 234B that moves outward in a lateral direction L of the deck 214 upon movement of the movable seat 234 from the first position towards the second position. In particular, the rear portions 234B of the movable seats 234 extend along a rear side of a mid-deck space B of the deck 214 while the movable seat 234 is in the first position, and the movable seat 234 opens access to the mid-deck space B of the deck 214 upon pivotal movement of the movable seat 234 from the first position towards the second position. Thus, similar to the first embodiment, the rear portions 234B of the movable seats 234 extend over a lateral end area of the aft deck 220 that is laterally outward of the rear ends 232B of the bulwark 232 while the movable seats 234 are in the second position.

Preferably, the watercraft 210 has a pair of support mechanisms (not shown) similar to the first embodiment for movably supporting the movable seats 234 on the deck 214 in the same manner as the first embodiment. Thus, the support mechanisms of the movable seats 234 will not be discussed or illustrated with respect to the watercraft 210.

Figure 18:
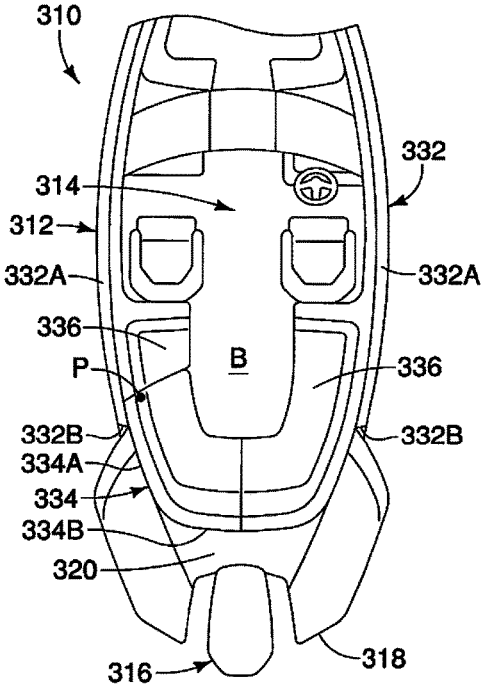
FIG. 18 is a partial top plan view of a watercraft (i.e., an outboard motor boat) in accordance with a third illustrated embodiment, with a movable seat in an interior facing position.
Figure 19:
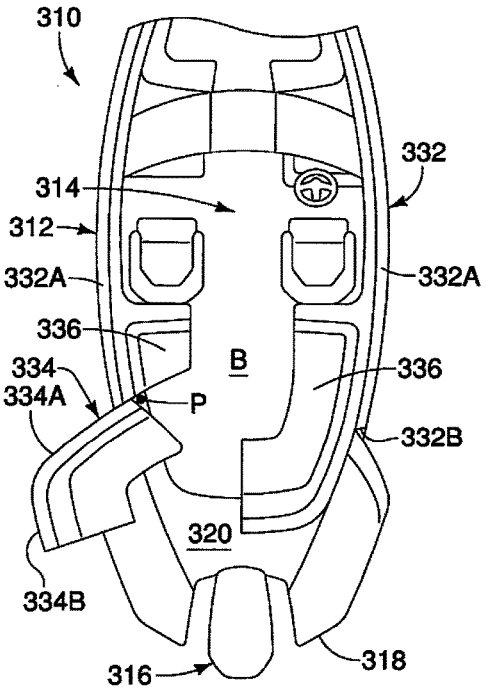
FIG. 19 is a partial top plan view of the watercraft illustrated in FIG. 18, with the movable seat in a water facing position.

Referring now to FIGS. 18 and 19, a watercraft 310 is illustrated in accordance with a third embodiment, which is identical to the second embodiment except that the mid-deck seating has been modified as explained below. Basically, the watercraft 310 comprises a hull 312, a deck 314 and a single propulsion unit 316 (i.e., an outboard motor). Here, the hull 312 has a rear portion 318 that is configured for the single propulsion unit 316 similar to the second embodiment. The deck 314 includes an aft deck 320 that is freely accessible from the lateral sides of the watercraft 310. The watercraft 310 further comprises a bulwark 332, a movable seat 334 and a pair of stationary seats 336. The bulwark 332 is identical to the bulwark 32 as discussed above. Thus, the bulwark 332 has a pair of lateral bulwark portions 332A that do not extend along the aft deck 320 and the movable seats 334 form a movable bulwark that extends from rear ends 332B of the bulwark 332 and then laterally across the watercraft 310.

Here, the movable seat 334 is movably mounted on the deck 314 to move between a first or retracted position (FIG. 18) and a second or extended position (FIG. 19). Here, the movable seat 334 includes a front portion 334A having a pivot axis P, and a rear portion 334B that moves outward in a lateral direction L of the deck 314 upon movement of the movable seat 334 from the first position towards the second position. In particular, the rear portion 334B of the movable seat 334 extends along a rear side of a mid-deck space B of the deck 314 while the movable seat 334 is in the first position, and the movable seat 334 opens access to the mid-deck space B of the deck 314 upon pivotal movement of the movable seat 334 from the first position towards the second position. Thus, the rear portion 334B of the movable seat 334 extends over a lateral end area of the aft deck 320 that is laterally outward of the rear end 332B of the bulwark 332 while the movable seat 334 is in the second position.

Preferably, the watercraft 310 has a support mechanism (not shown) similar to the first embodiment for movably supporting the movable seat 334 on the deck 314 in the same manner as the first embodiment. Thus, the support mechanism of the movable seat 334 will not be discussed or illustrated with respect to the watercraft 310.

Figure 20:
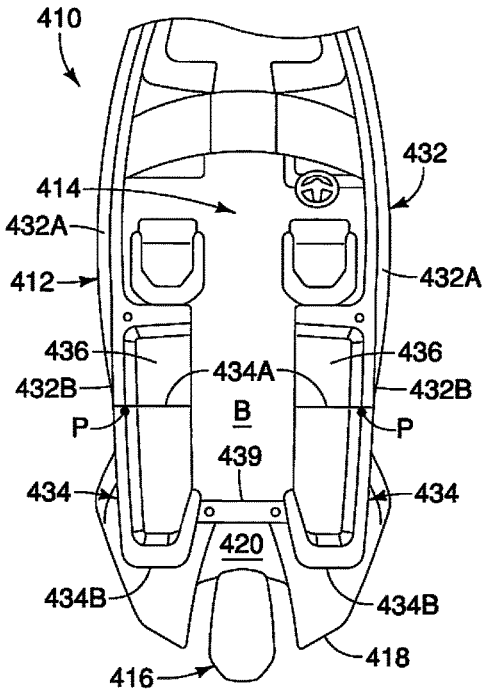
FIG. 20 is a partial top plan view of a watercraft (i.e., an outboard motor boat) in accordance with a fourth illustrated embodiment, with a pair of movable seats in retracted positions (interior facing positions)
Figure 21:
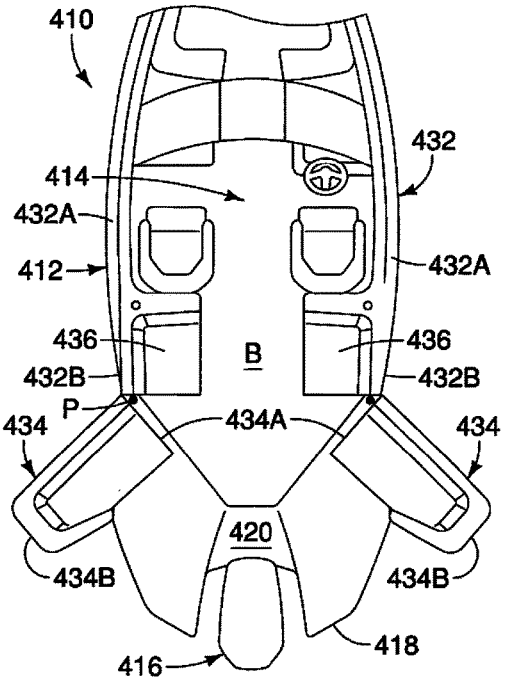
FIG. 21 is a partial top plan view of the watercraft illustrated in FIG. 20, with the movable seats in the extended positions (water facing positions)

Referring now to FIGS. 20 and 21, a watercraft 410 is illustrated in accordance with a fourth embodiment, which is identical to the second embodiment except that the mid-deck seating has been modified as explained below. Basically, the watercraft 410 comprises a hull 412, a deck 414 and a single propulsion unit 416 (i.e., an outboard motor). Here, the hull 412 has a rear portion 418 that is configured for the single propulsion unit 416 similar to the second embodiment. The deck 414 includes an aft deck 420 that is freely accessible from the lateral sides of the watercraft 410. The watercraft 410 further comprises a bulwark 432, a pair of movable seats 434 and a pair of stationary seats 436. The bulwark 432 is identical to the bulwark 32 as discussed above. Thus, the bulwark 432 has a pair of lateral bulwark portions 432A that do not extend along the aft deck 420 and the movable seats 434 form a movable bulwark that extends from rear ends 432B of the bulwark 432 along the sides of the watercraft 410.

Here, the movable seats 434 are movably mounted on the deck 414 to move between a first or retracted position (FIG. 20) and a second or extended position (FIG. 21). Here, each of the movable seats 434 includes a front portion 434A having a pivot axis P, and a rear portion 434B that moves outward in a lateral direction L of the deck 414 upon movement of the movable seat 434 from the first position towards the second position. Here, in the fourth embodiment, the rear portions 434B of the movable seats 434 are spaced from each other while the movable seats 434 are in the first position. Thus, a removable partition 439 is attached to the rear portions 434B of the movable seats 434 to close off the mid-deck space B from the aft deck 420 while the movable seats 434 are in the first position. Before the movable seats 434 are moved to the second position, the removable partition 439 is detached from the rear portions 434B of the movable seats 434 and stowed away. Then, the movable seat 434 can be moved to more widely open access to the mid-deck space B of the deck 414 upon pivotal movement of the movable seat 434 from the first position towards the second position. Thus, similar to the first embodiment, the rear portions 434B of the movable seats 434 extend over a lateral end area of the aft deck 420 that is laterally outward of the rear ends 432B of the bulwark 432 while the movable seats 434 are in the second position. The removable partition 439 is reattached to the rear portions 434B of the movable seats 434 to close off the mid-deck space B from the aft deck 420 when the movable seats 434 are returned the first position.

Preferably, the watercraft 410 has a pair of support mechanisms (not shown) similar to the first embodiment for movably supporting the movable seats 434 on the deck 414 in the same manner as the first embodiment. Thus, the support mechanisms of the movable seats 434 will not be discussed or illustrated with respect to the watercraft 410.

Figure 22:
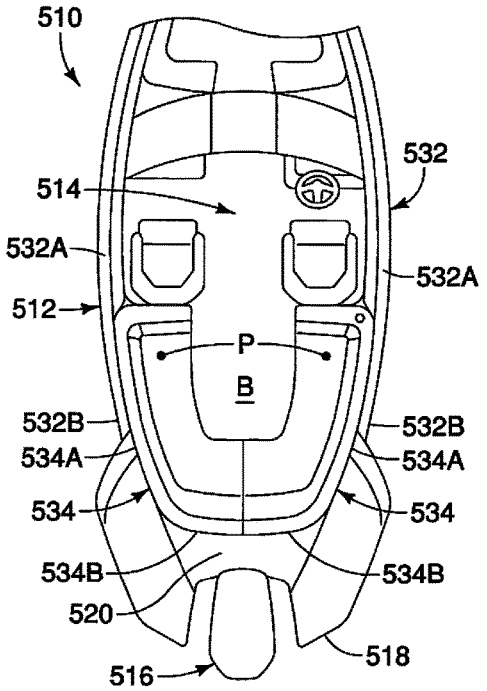
FIG. 22 is a partial top plan view of a watercraft (i.e., an outboard motor boat) in accordance with a fifth illustrated embodiment, with a pair of movable seats in retracted positions (interior facing positions)
Figure 23:
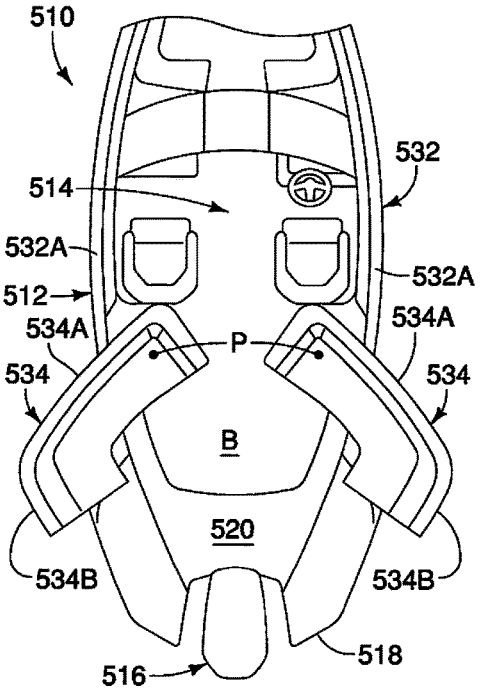
FIG. 23 is a partial top plan view of the watercraft illustrated in FIG. 22, with the movable seats in the extended positions (water facing positions)
Figure 24:
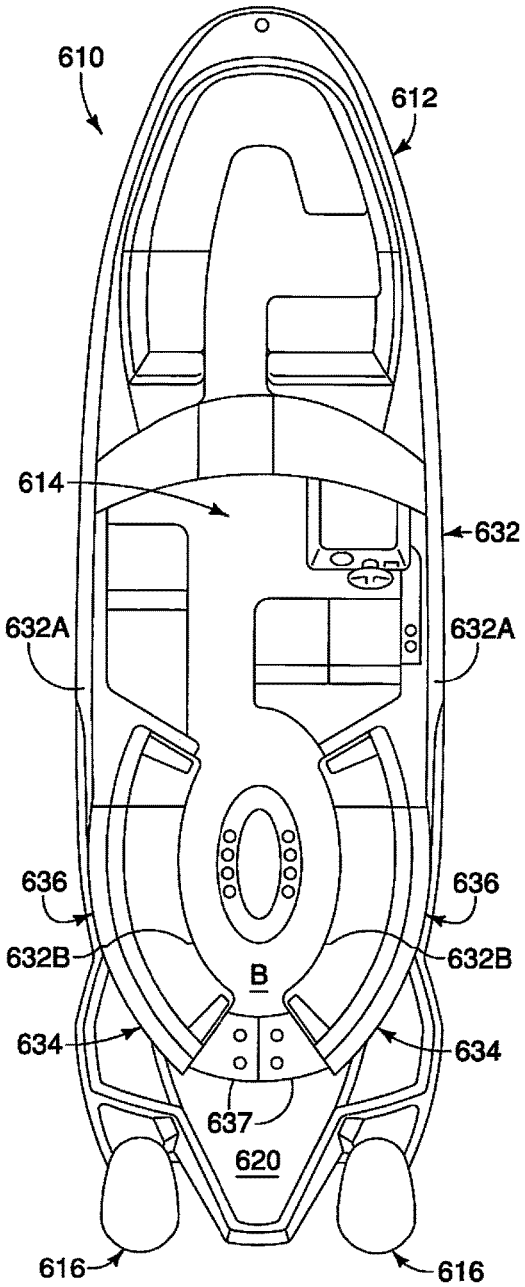
FIG. 24 is a top plan view of a watercraft (i.e., an outboard motor boat) in accordance with a sixth illustrated embodiment, with a pair of movable seats in retracted positions (interior facing positions) and a swimming deck in a stowed (not seen) position.
Figure 25:
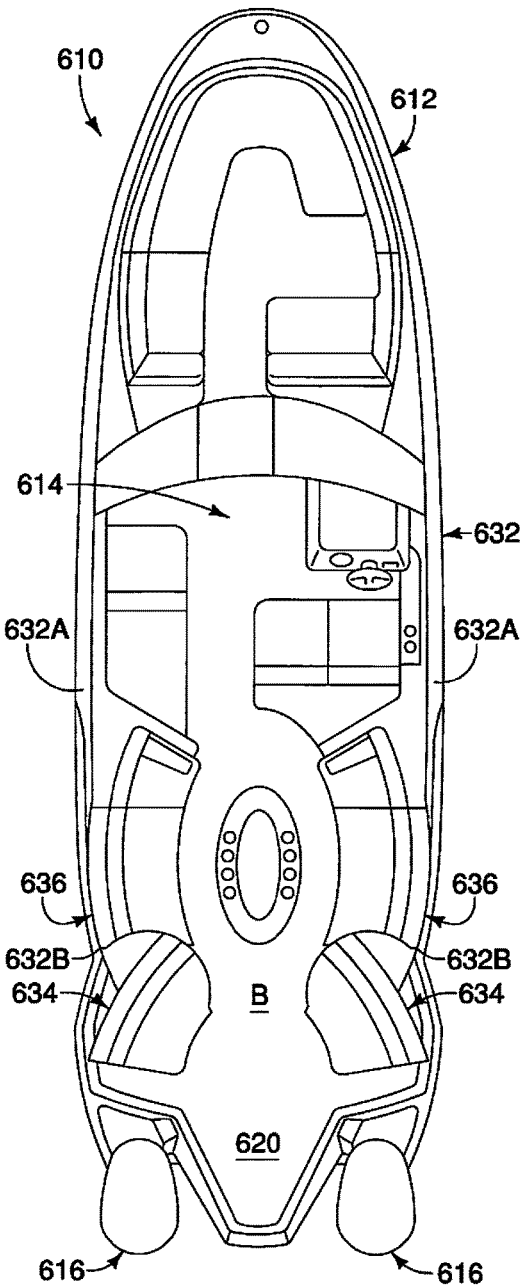
FIG. 25 is a top plan view of the watercraft illustrated in FIG. 24, with the movable seats in the extended positions (water facing positions)
Figure 26:
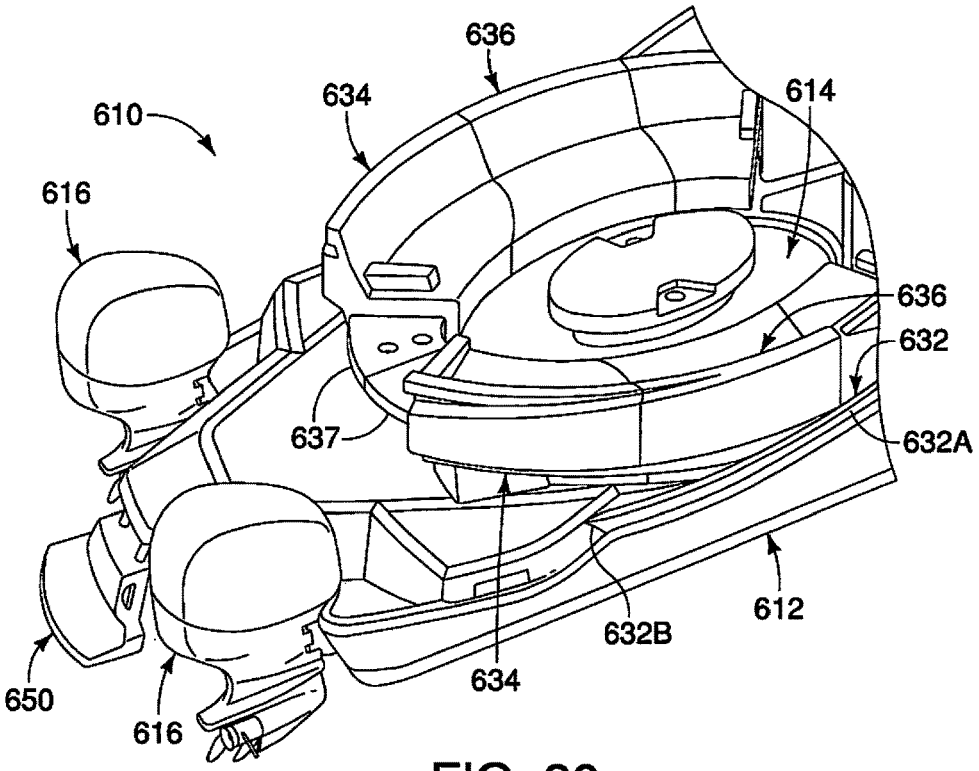
FIG. 26 is a partial rear perspective view of the watercraft illustrated in FIGS. 24 and 25, with the movable seats in the retracted positions and the swimming deck in an in-use position.
Figure 27:
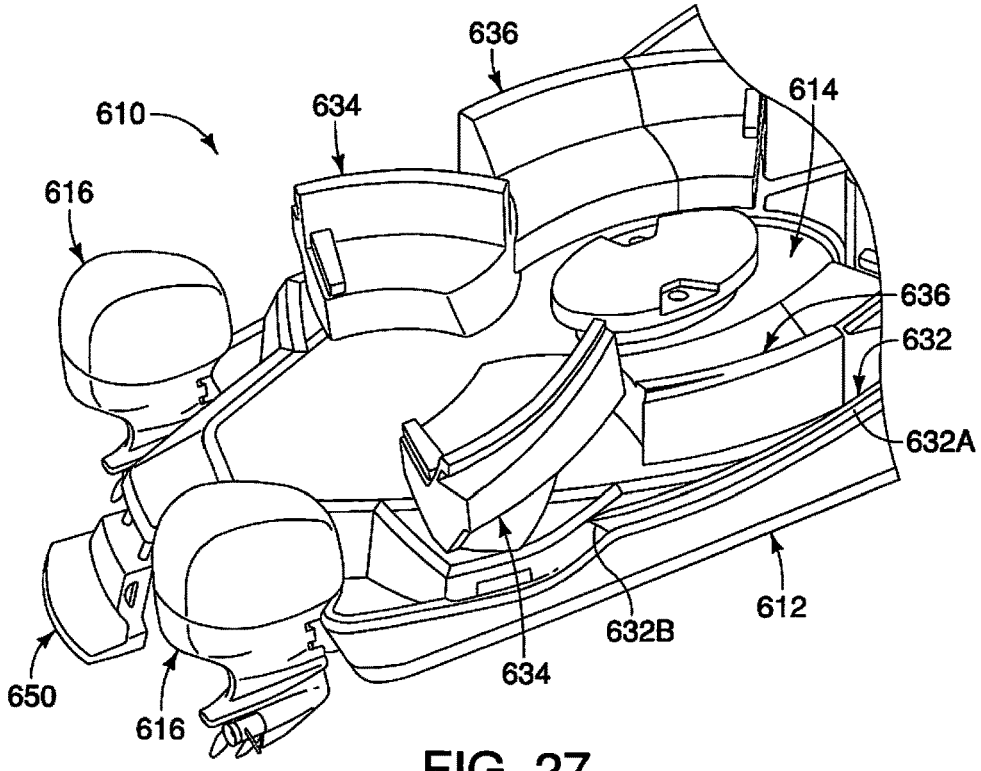
FIG. 27 is a partial rear perspective view, similar to FIG. 26, of the watercraft illustrated in FIGS. 24 to 26, but with the movable seats in the extended positions.
Figure 28:
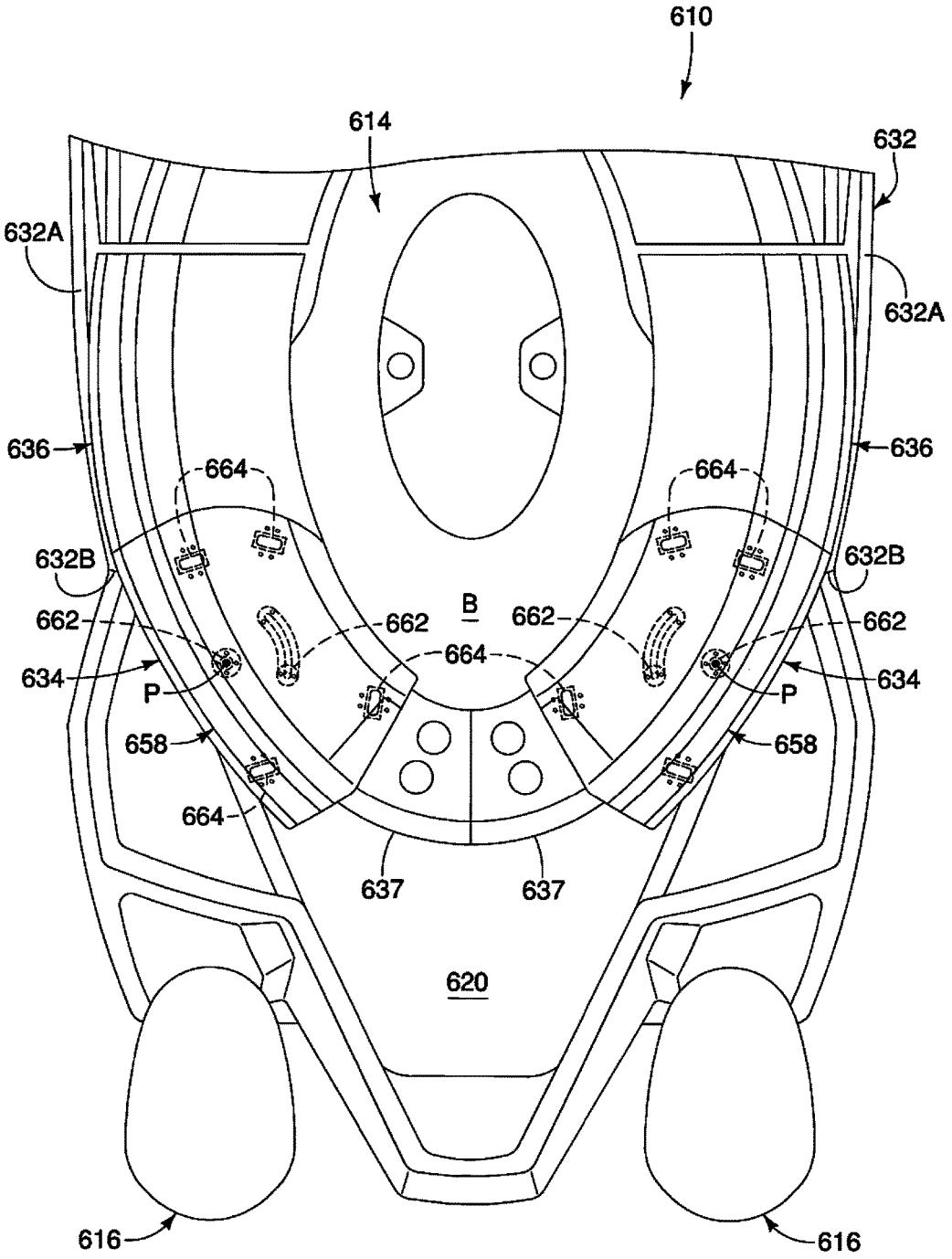
FIG. 28 is a partial top plan view of the watercraft illustrated in FIGS. 24 to 27, with the movable seats in the retracted positions (interior facing positions)
Figure 29:
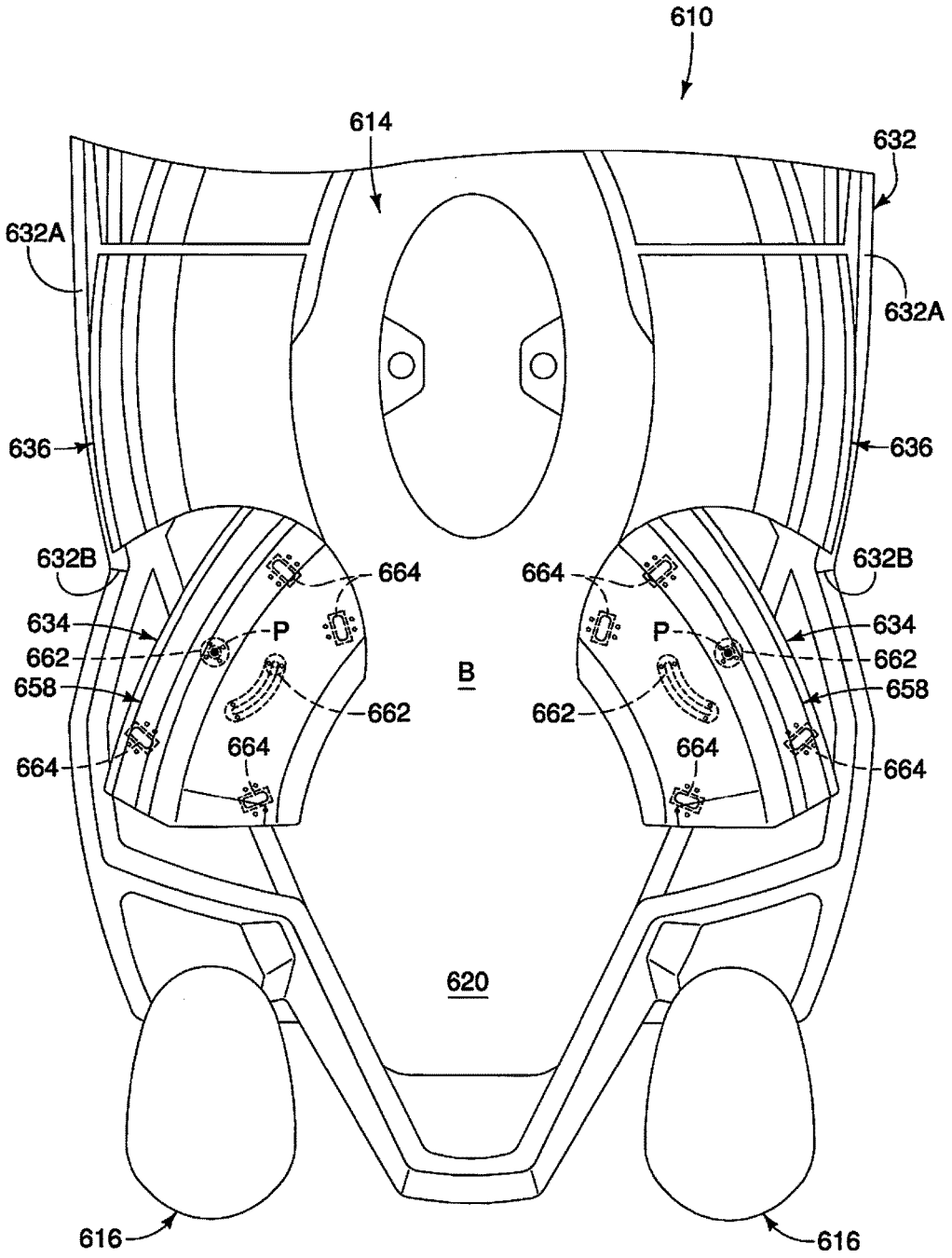
FIG. 29 is a partial top plan view of the watercraft illustrated in FIGS. 24 to 28, with the movable seats in the extended positions (water facing positions)

Referring now to FIGS. 22 and 23, a watercraft 510 is illustrated in accordance with a fifth embodiment, which is identical to the second embodiment except that the mid-deck seating has been modified as explained below. Here, in the fifth embodiment, the watercraft 510 is an outboard motor boat. Basically, the watercraft 510 comprises a hull 512, a deck 514 and a single propulsion unit 516 (i.e., an outboard motor). Here, the hull 512 has a rear portion 518 that is configured for the single propulsion unit 516 similar to the second embodiment. The deck 514 includes an aft deck 520 that is freely accessible from the lateral sides of the watercraft 510. The watercraft 510 further comprises a bulwark 532 and a pair of movable seats 534. Here, in the fifth embodiment, the stationary seats of the second embodiment have been made part of the movable seats 534. The bulwark 532 is identical to the bulwark 32 as discussed above. Thus, the bulwark 532 has a pair of lateral bulwark portions 532A that do not extend along the aft deck 520 and the movable seats 534 form a movable bulwark that extends from rear ends 532B of the bulwark 532 and then laterally across the watercraft 510.

Here, the movable seats 534 are movably mounted on the deck 514 to move between a first or retracted position (FIG. 22) and a second or extended position (FIG. 23). Here, each of the movable seats 534 includes a front portion 534A having a pivot axis P, and a rear portion 534B that moves outward in a lateral direction L of the deck 514 upon movement of the movable seat 534 from the first position towards the second position. In particular, the rear portions 534B of the movable seats 534 extend along a rear side of a mid-deck space B of the deck 514 while the movable seat 534 is in the first position, and the movable seat 534 opens access to the mid-deck space B of the deck 514 upon pivotal movement of the movable seat 534 from the first position towards the second position. Thus, similar to the first embodiment, the rear portions 534B of the movable seats 534 extend over a lateral end area of the aft deck 520 that is laterally outward of the rear ends 532B of the bulwark 532 while the movable seats 534 are in the second position.

Preferably, the watercraft 510 has a pair of support mechanisms (not shown) similar to the first embodiment for movably supporting the movable seats 534 on the deck 514 in the same manner as the first embodiment. Thus, the support mechanisms of the movable seats 534 will not be discussed or illustrated with respect to the watercraft 510.

Referring now to FIGS. 24 to 29, a watercraft 610 is illustrated in accordance with a sixth embodiment. Here, the watercraft 610 is identical to the watercraft 10 except that the mid-deck seating has been modified as explained below. Basically, the watercraft 610 comprises a hull 612, a deck 614 and a pair of propulsion units 616 (i.e., outboard motors). Thus, in the sixth embodiment, the watercraft 610 is an outboard motor boat. Here, the hull 612 is identical to the hull 12 of the first embodiment. The deck 614 includes an aft deck 620 that is freely accessible from the lateral sides of the watercraft 610. The watercraft 610 further comprises a bulwark 632, a pair of movable seats 634 and a pair of stationary seats 636. The bulwark 632 is identical to the bulwark 32 as discussed above. Thus, the bulwark 632 has a pair of lateral bulwark portions 632A that do not extend along the aft deck 620. Here, the seatbacks of the movable seats 634 form a movable bulwark that extends from rear ends 632B of the bulwark 632. Each of the movable seats 634 is provided with an extendable and retractable table 637. In this sixth embodiment, the hull 612 is provided with a swimming deck 650 that is identical to the swimming deck 50 of the first embodiment.

Here, the movable seats 634 are movably mounted from a primarily forward facing direction (FIGS. 26 and 28) of the watercraft 610 to a primarily rearward facing direction (FIGS. 27 and 29) of the watercraft 610 upon movement of the movable seat 634 from the first position towards the second position. As used herein, the phrase "primarily forward facing direction" refers to a direction that is more forward facing than rearward facing. Also as used herein, the phrase "primarily rearward facing direction" refers to a direction that is more rearward facing than forward facing. Each of the movable seats 634 has a seating direction that faces a front face of one of the propulsion units 616 (i.e., one of the outboard motors) while the movable seat 634 is in the second position. Each of the movable seats 634 has a support mechanism 658 having a pair of support posts 662 and a plurality of rollers 664 for movably supporting the movable seats 634 on the deck 614. Here, one of the support post 662 of each of the support mechanisms 658 defines the pivot axis P about which the movable seat 634 pivots with respect to the deck 614. Each of the movable seats 634 includes a middle portion having the pivot axis P. Each of the movable seats 634 includes a rear portion that moves outward in the lateral direction L of the deck 614 upon movement of the movable seats 634 from the first positions toward the second positions.

Figure 30:
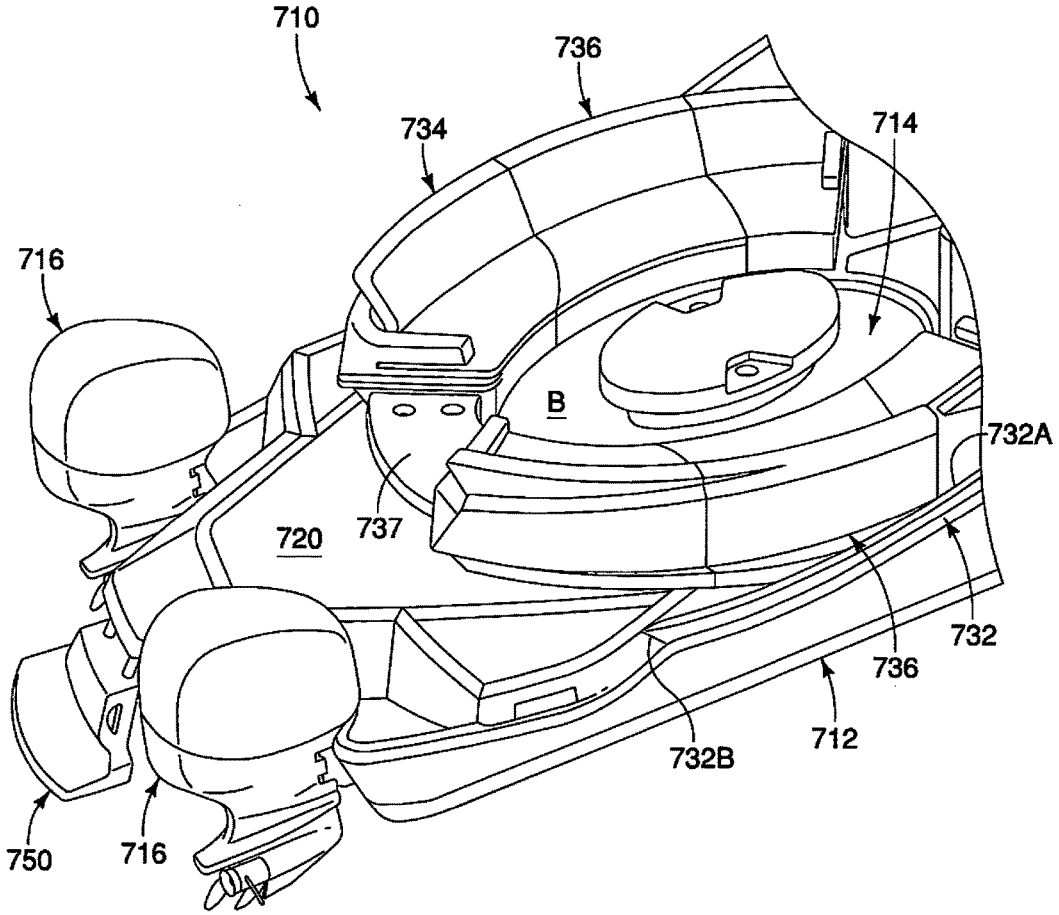
FIG. 30 is a partial rear perspective view of a watercraft (i.e., an outboard motor boat) in accordance with a seventh illustrated embodiment, with a pair of movable seats in retracted positions (interior facing positions) and a swimming deck in an in-use position.
Figure 31:
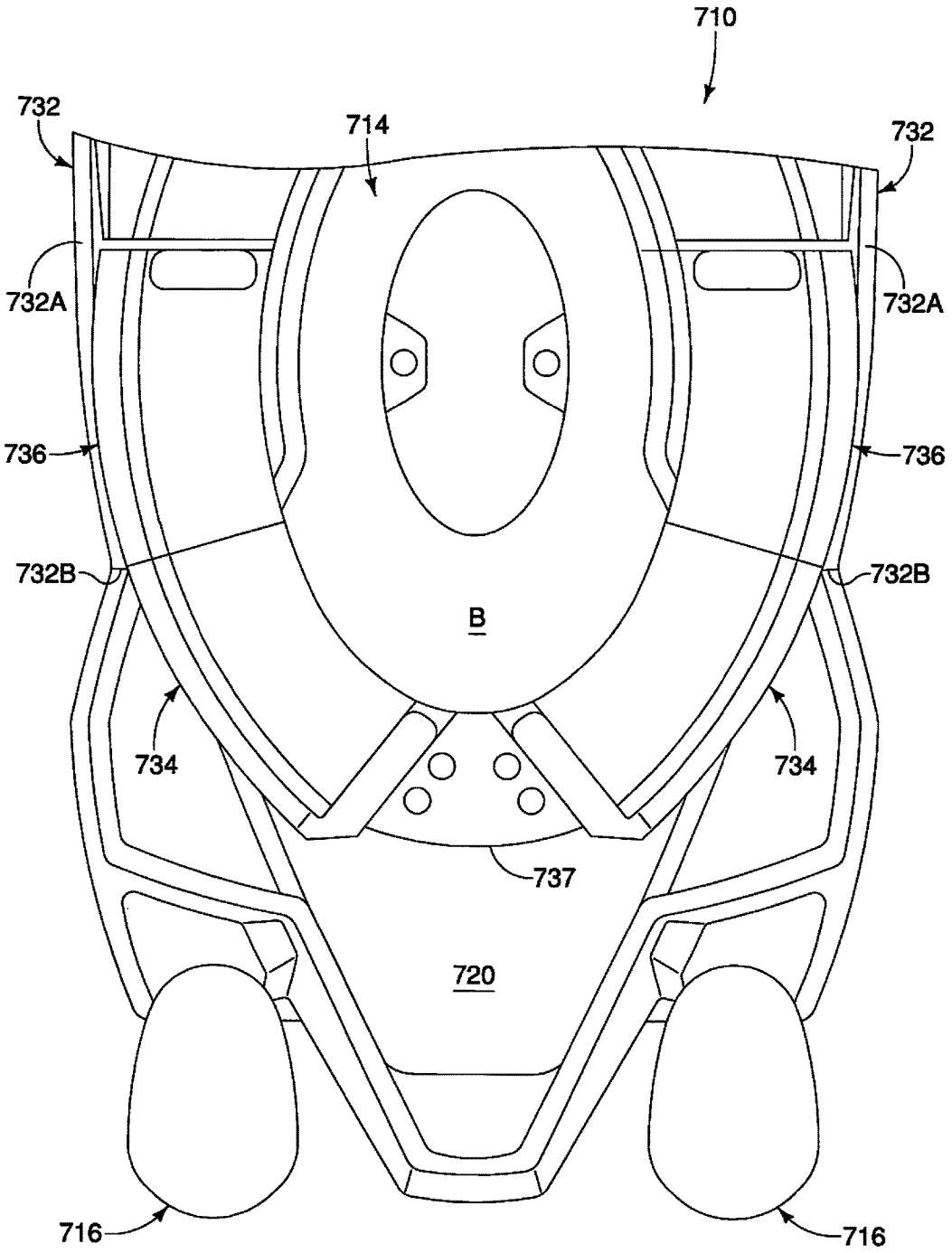
FIG. 31 is a partial top plan view of the watercraft illustrated in FIG. 30, with the movable seats in the retracted positions (interior facing positions)
Figure 32:
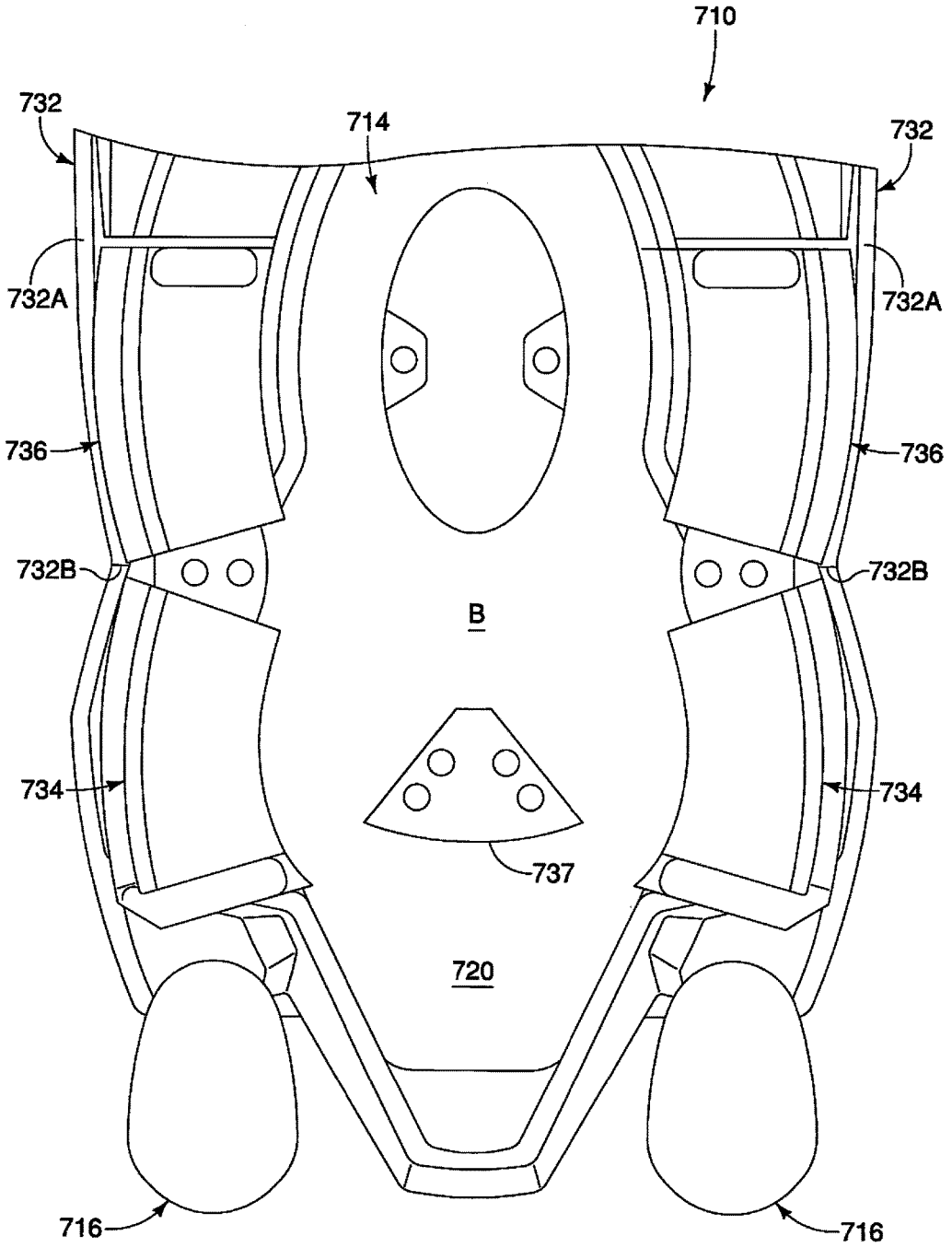
FIG. 32 is a partial top plan view of the watercraft illustrated in FIGS. 30 and 31, with the movable seats in the extended positions (water facing positions)

Referring now to FIGS. 30 to 32, a watercraft 710 is illustrated in accordance with a seventh embodiment. Here, the watercraft 710 is identical to the watercraft 10 except that the mid-deck seating has been modified as explained below. Basically, the watercraft 710 comprises a hull 712, a deck 714 and a pair of propulsion units 716 (i.e., outboard motors). Thus, in the seventh embodiment, the watercraft 710 is an outboard motor boat. Here, the hull 712 is identical to the hull 12 of the first embodiment. The deck 714 includes an aft deck 720 that is freely accessible from the lateral sides of the watercraft 710. The watercraft 710 further comprises a bulwark 732, a pair of movable seats 734 and a pair of stationary seats 736. The bulwark 732 is identical to the bulwark 32 as discussed above. Thus, the bulwark 732 has a pair of lateral bulwark portions 732A that do not extend along the aft deck 720. Here, the seatbacks of the movable seats 734 form a movable bulwark that extends from rear ends 732B of the bulwark 732. Here, a stationary table 737 is provided at a location on the deck 714 such that the rear portions of the movable seats 734 meet with a stationary table 737. In this seventh embodiment, the hull 712 is provided with a swimming deck 750 that is identical to the swimming deck 50 of the first embodiment.

Here, the movable seat 734 is movably mounted from a lateral-forward facing direction (FIGS. 30 and 31) of the watercraft 710 to a more laterally facing direction (FIG. 32) of the watercraft 710 upon movement of the movable seat 734 from the first position towards the second position. Each of the movable seats 734 has a support mechanism (not shown) with rollers similar to the rollers in the first embodiment for movably supporting the movable seats 734 on the deck 714.

Figure 33:
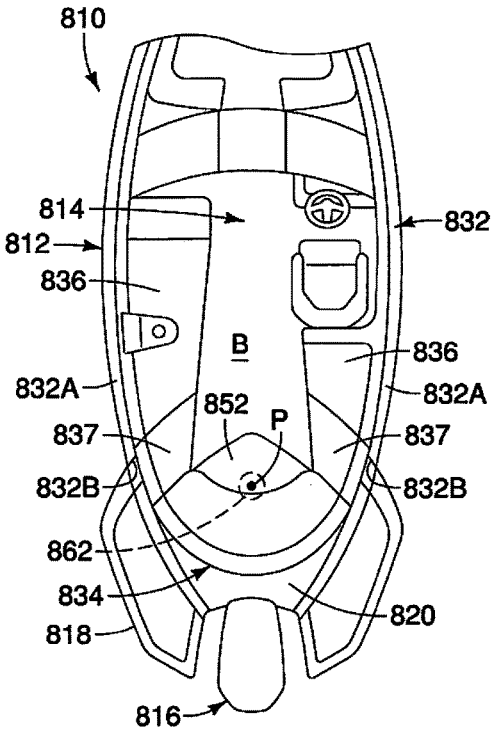
FIG. 33 is a partial top plan view of a watercraft (i.e., an outboard motor boat) in accordance with an eighth illustrated embodiment, with a movable seat in a forward (interior) facing position.
Figure 34:
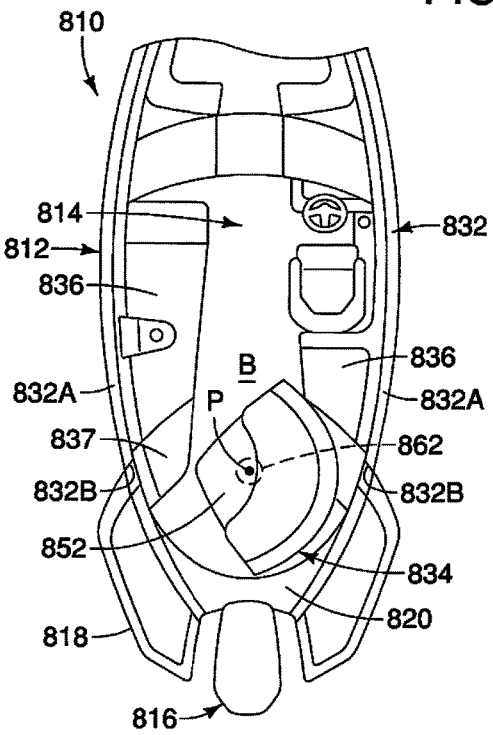
FIG. 34 is a partial top plan view of the watercraft illustrated in FIG. 33, with the movable seat in a lateral facing position.
Figure 35:
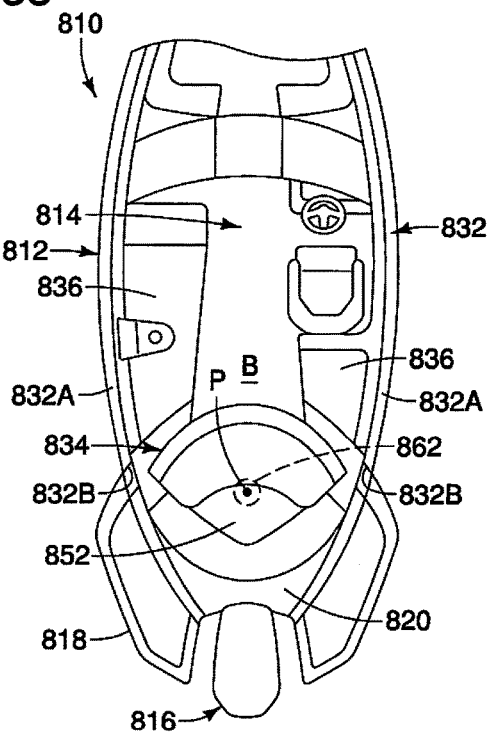
FIG. 35 is a partial top plan view of the watercraft illustrated in FIGS. 33 and 34, with the movable seat in a rearward (water) facing position.

Referring now to FIGS. 33 to 35, a watercraft 810 is illustrated in accordance with an eighth embodiment. Here, in the eighth embodiment, the watercraft 810 is an outboard motor boat. Basically, the watercraft 810 comprises a hull 812, a deck 814 and a single propulsion unit 816 (i.e., an outboard motor). The hull 812 has a rear portion 818 that is configured for the single propulsion unit 816 similar to the second embodiment. The deck 814 includes an aft deck 820 that is freely accessible from the lateral sides of the watercraft 810. The watercraft 810 further comprises a bulwark 832, a movable seat 834, a pair of stationary seats 836 and a pair of removable seats 837. The bulwark 832 is identical to the bulwark 32 as discussed above. Thus, the bulwark 832 has a pair of lateral bulwark portions 832A that do not extend along the aft deck 820. Here, the seatback of the movable seat 834 form a movable bulwark that extends from rear ends 832B of the bulwark 832 and then laterally across the watercraft 810. In this way, the mid-deck space B is separated from the aft deck 820.

Here, the movable seat 834 is movably mounted on the deck 814 to move between a first position (FIG. 33) and a second position (FIG. 35). However, the removable seats 837 need to be removed in order to rotate the movable seat 834 from the first position towards the second position. As seen in FIGS. 34 and 35, first one of the removable seats 837 can be removed so that the movable seat 834 can be moved to an intermediate position (FIG. 34), and then the other one of the removable seats 837 can be removed so that the movable seat 834 can be moved to the second position (FIG. 35). The movable seat 834 is movably mounted from a forward facing direction of the watercraft 810 to a rearward facing direction of the watercraft 810 upon movement of the movable seat 834 from the first position towards the second position. As seen in FIG. 34, while the movable seat 834 is in the intermediate position, a mid-deck space B between the stationary seats 836 can be easily accessed from the aft deck 820. In this eighth embodiment, the movable seat 834 includes a base 852 pivotally mounted to the deck 814 by a support post 862 to pivot about a pivot axis P. The base 852 has a support mechanism (not shown) with rollers similar to the rollers in the first embodiment for movably supporting the movable seat 834 on the deck 814. Preferably, a locking arrangement is provided for locking the movable seat 834 in each of the first position, the intermediate position and the second position.

Figure 36:
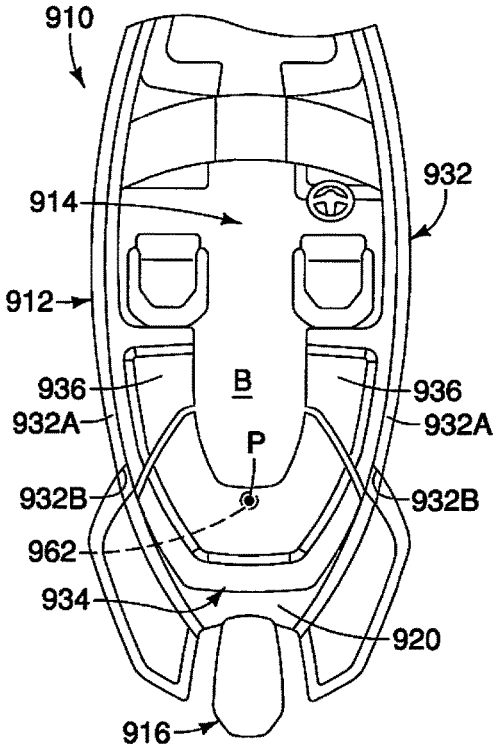
FIG. 36 is a partial top plan view of a watercraft (i.e., an outboard motor boat) in accordance with a ninth illustrated embodiment, with a movable seat in a forward (interior) facing position.
Figure 37:
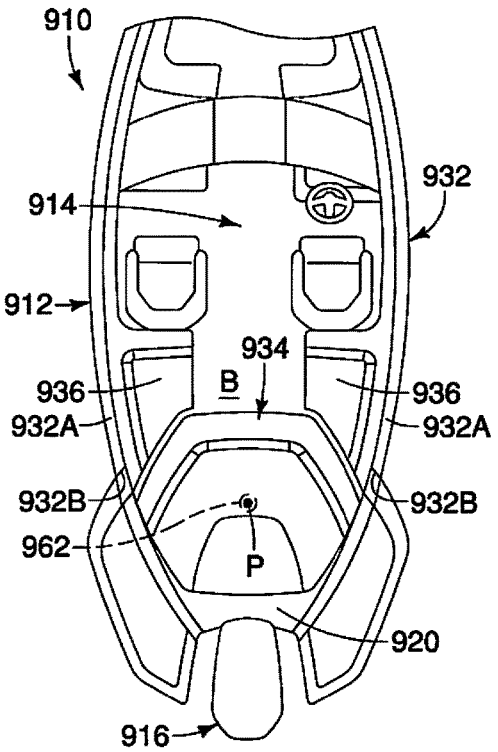
FIG. 37 is a partial top plan view of the watercraft illustrated in FIG. 36, with the movable seat in a rearward (water) facing position.

Referring now to FIGS. 36 and 37, a watercraft 910 is illustrated in accordance with a ninth embodiment. Here, in the ninth embodiment, the watercraft 910 is an outboard motor boat. Basically, the watercraft 910 comprises a hull 912, a deck 914 and a single propulsion unit 916 (i.e., an outboard motor). The hull 912 is basically the same as the hull 212 of the second embodiment. The deck 914 includes an aft deck 920 that is freely accessible from the lateral sides of the watercraft 910. The watercraft 910 further comprises a bulwark 932, a movable seat 934 and a pair of stationary seats 936. The bulwark 932 is identical to the bulwark 32 as discussed above. Thus, the bulwark 932 has a pair of lateral bulwark portions 932A that do not extend along the aft deck 920. Here, the seatback of the movable seat 934 form a movable bulwark that extends from rear ends 932B of the bulwark 932 and then laterally across the watercraft 910. In this way, the mid-deck space B is separated from the aft deck 920.

Here, the movable seat 934 is movably mounted on the deck 914 to move between a first position (FIG. 36) and a second position (FIG. 37). The movable seat 934 is movably mounted from a forward facing direction of the watercraft 910 to a rearward facing direction of the watercraft 910 upon movement of the movable seat 934 from the first position towards the second position. In this ninth embodiment, the movable seat 934 is pivotally mounted to the deck 914 by a support post 962 to pivot about a pivot axis P. The movable seat 934 has a support mechanism (not shown) with rollers similar to the rollers in the first embodiment for movably supporting the movable seat 934 on the deck 914. Preferably, a locking arrangement is provided for locking the movable seat 934 in each of the first and second positions.

Figure 38:
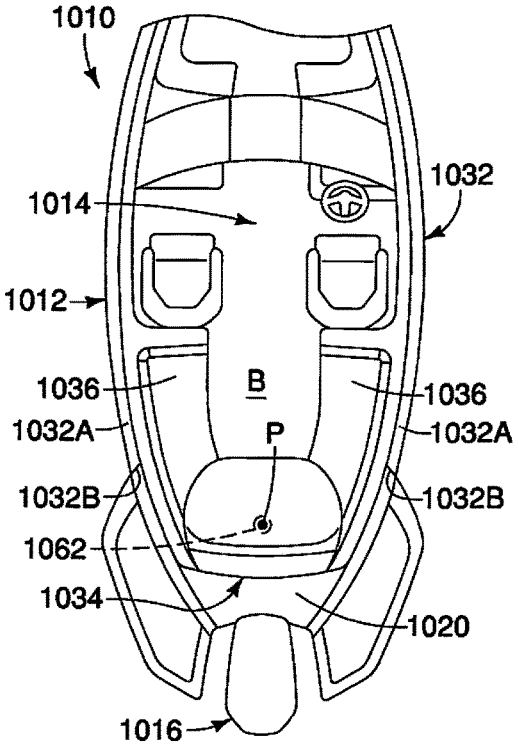
FIG. 38 is a partial top plan view of a watercraft (i.e., an outboard motor boat) in accordance with a tenth illustrated embodiment, with a movable seat in a forward (interior) facing position.
Figure 39:
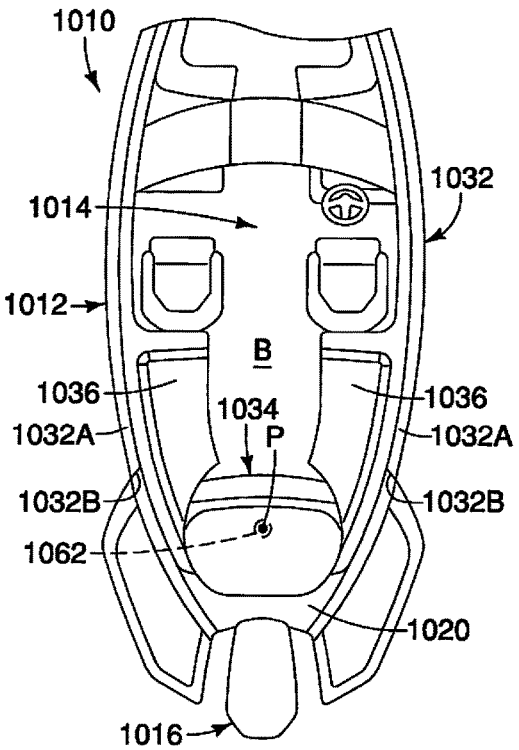
FIG. 39 is a partial top plan view of the watercraft illustrated in FIG. 38, with the movable seat in a rearward (water) facing position.

Referring now to FIGS. 38 and 39, a watercraft 1010 is illustrated in accordance with a tenth embodiment. Here, in the tenth embodiment, the watercraft 1010 is an outboard motor boat. Basically, the watercraft 1010 comprises a hull 1012, a deck 1014 and a single propulsion unit 1016 (i.e., an outboard motor). The hull 1012 is basically the same as the hull 212 of the second embodiment. The deck 1014 includes an aft deck 1020 that is freely accessible from the lateral sides of the watercraft 1010. The watercraft 1010 further comprises a bulwark 1032, a movable seat 1034 and a pair of stationary seats 1036. The bulwark 1032 is identical to the bulwark 32 as discussed above. Thus, the bulwark 1032 has a pair of lateral bulwark portions 1032A that do not extend along the aft deck 1020. Here, the seatback of the movable seat 1034 form a movable bulwark that extends from rear ends 1032B of the bulwark 1032 and then laterally across the watercraft 1010. In this way, the mid-deck space B is separated from the aft deck 1020.

Here, the movable seat 1034 is movably mounted on the deck 1014 to move between a first position (FIG. 38) and a second position (FIG. 39). The movable seat 1034 is movably mounted from a forward facing direction of the watercraft 1010 to a rearward facing direction of the watercraft 1010 upon movement of the movable seat 1034 from the first position towards the second position. In this tenth embodiment, the movable seat 1034 is pivotally mounted to the deck 1014 by a support post 1062 to pivot about a pivot axis P. The movable seat 1034 has a support mechanism (not shown) with rollers similar to the rollers in the first embodiment for movably supporting the movable seat 1034 on the deck 1014. Preferably, a locking arrangement is provided for locking the movable seat 1034 in each of the first and second positions.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Thus, as used herein, the singular forms "a," "an" and "the" are intended to include the plural forms as well, unless the context clearly indicates otherwise. Also, the terms "part," "section," "portion," "member" or "element" when used in the singular can have the dual meaning of a single part or a plurality of parts. Unless otherwise defined, all terms (including technical and scientific terms) used herein have the same meaning as commonly understood by one of ordinary skill in the art to which illustrative embodiments of the inventive concepts belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. As used herein the term "and/or" includes any and all combinations of one or more of the associated listed items. Additionally, similar words used to describe the relationship between elements or layers should be interpreted in a like fashion (e.g., "between" versus "directly between", "above" versus "directly above", "below" versus "directly below", "adjacent" versus "directly adjacent," "on" versus "directly on"). Thus, components that are shown directly connected or contacting each other can have intermediate structures disposed between them unless specified otherwise.

It will be understood that, although the terms "first", "second", etc. may be used herein to describe various elements, components, regions, layers, positions and/or sections, these elements, components, regions, layers, positions and/or sections should not be limited by these terms. These terms are only used to distinguish one element, component, region, layer, position or section from another element, component, region, layer, position or section. Thus, a first element, component, region, layer, position or section discussed above could be termed a second element, component, region, layer, position or section without departing from the teachings of illustrative embodiments.

Spatially relative terms, such as "forward", "rearward", "above", "below", "beneath", "downward", "vertical", "horizontal", and "transverse" as well as any other similar spatial terms may be used herein for the ease of description to describe one element or feature's relationship to another element(s) or feature(s) of the above embodiments. These terms, as utilized to describe the present invention should be interpreted relative to a watercraft floating in calm water.

The terms of degree such as "substantially", "about" and "approximately" as used herein mean an amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. An outboard motor boat comprising:

a hull including a rear portion with a first section and a second section;

a deck provided on the hull;

at least one outboard motor mounted to the rear portion of the hull; and a bulwark provided on the deck, the deck including an aft deck in the rear of the deck, the aft deck including a first part disposed forward of the outboard motor and a second part extending rearward with respect to the first part in a fore-to-aft direction, the first part being at least partially disposed in a non-overlapping location with respect to the outboard motor and the bulwark as viewed from a side view of the outboard motor boat, the second part extending along a lateral portion of the outboard motor, the first section of the hull being disposed directly beneath the first part of the aft deck, the second section of the hull being disposed directly beneath the second part of the aft deck, the second section of the hull having a lowermost surface that lies above a lowermost surface of the first section of the hull, the first part of the aft deck having an upper deck surface that extends laterally and horizontally from a position between the bulwark and the outboard motor in the fore-to-aft direction to an outer edge of the deck that defines an outer periphery of the outboard motor boat.

2. The outboard motor boat according to claim 1, wherein the second part of the aft deck has a shape that is spaced away from the outboard motor as moving rearward so as not to interfere with the outboard motor while steering the outboard motor.

3. The outboard motor boat according to claim 1, wherein the at least one outboard motor includes two outboard motors, and the second part of the aft deck extending into an area located laterally between the outboard motors.

4. The outboard motor boat according to claim 3, wherein the second part of the aft deck becomes narrower as the second part of the aft deck extends rearward in the fore-to-aft direction between the outboard motors.

5. The outboard motor boat according to claim 1, wherein the second part of the aft deck has an upper deck surface that lies either below the upper deck surface of the first part of the aft deck or substantially in a same plane as the upper deck surface of the first part of the aft deck.

6. The outboard motor boat according to claim 1, further comprising a swimming deck mounted to the aft deck, the swimming deck including at least one step above a water line of the hull and at least one step under.

7. The outboard motor boat according to claim 6, wherein the swimming deck is pivotally mounted to the aft deck between an in-use position and a stowed position.

8. The outboard motor boat according to claim 1, wherein the bulwark gradually slopes downward towards the deck as approaching the aft deck in the fore-to-aft direction, the bulwark having a rear end that converges with the upper deck surface of the deck, and the first part of the aft deck is disposed forward of the outboard motor and rearward of the rear end of the bulwark.

9. An outboard motor boat comprising:

a hull including a rear portion;

a deck provided on the hull;

at least one outboard motor mounted to the rear portion of the hull;

a bulwark provided on the deck; and a swimming deck, the deck including an aft deck in the rear of the deck, the aft deck including a first part disposed forward of the outboard motor and a second part extending rearward with respect to the first part in a fore-to-aft direction, the first part being at least partially disposed in a non-overlapping location with respect to the outboard motor and the bulwark as viewed from a side view of the outboard motor boat, the second part extending along a lateral portion of the outboard motor, the swimming deck being pivotally mounted to the aft deck between an in-use position and a stowed position, the swimming deck being disposed underneath the second part of the aft deck while in the stowed position and disposed rearward of the aft deck while in the in-use position.

10. The outboard motor boat according to claim 9, wherein the swimming deck includes a step that is substantially parallel to the an upper deck surface of the second part of the aft deck while in the in-use position, and that is substantially parallel to a rear face of the hull while in the stowed position.

11. The outboard motor boat according to claim 9, wherein the swimming deck has a pivot angle of 100 degrees to 120 degrees.

12. An outboard motor boat comprising:

a hull including a rear portion;

a deck provided on the hull;

at least one outboard motor mounted to the rear portion of the hull;

a bulwark provided on the deck; and at least one seat, the deck including a mid-deck laterally aligned with the bulwark and an aft deck having a first part disposed between the bulwark and the outboard motor with respect to a fore-to-aft direction, the first part being at least partially disposed in a non-overlapping location with respect to the outboard motor and the bulwark as viewed from a side view of the outboard motor boat, the first part of the aft deck having an upper deck surface that lies either below an upper deck surface of the mid-deck or substantially in a same plane as the upper deck surface of the mid-deck, the at least one seat being disposed on the mid-deck such that the upper deck surface of the mid-deck lies below the at least one seat, the upper deck surface of the first part of the aft deck extending laterally and horizontally from a position between the bulwark and the outboard motor in the fore-to-aft direction to an outer edge of the deck that defines an outer periphery of the outboard motor boat.

13. The outboard motor boat according to claim 12, wherein the aft deck further includes a second part extending rearward with respect to the first part and along a lateral portion of the outboard motor, the second part of the aft deck has a shape that is spaced away from the outboard motor as moving rearward so as not to interfere with the outboard motor while steering the outboard motor.

14. The outboard motor boat according to claim 12, wherein the at least one outboard motor includes two outboard motors, and the second part of the aft deck extending into an area located laterally between the outboard motors.

15. The outboard motor boat according to claim 14, wherein the second part of the aft deck becomes narrower as the second part of the aft deck extends rearward in the fore-to-aft direction between the outboard motors.

16. The outboard motor boat according to claim 12, further comprising a swimming deck mounted to the aft deck, the swimming deck including at least one step above a water line of the hull and at least one step under.

17. The outboard motor boat according to claim 16, wherein the swimming deck is pivotally mounted to the aft deck between an in-use position and a stowed position.

18. An outboard motor boat comprising:

a hull including a rear portion;

a deck provided on the hull;

at least one outboard motor mounted to the rear portion of the hull;

a bulwark provided on the deck;

at least one seat; and a swimming deck, the deck including a mid-deck laterally aligned with the bulwark and an aft deck having a first part disposed between the bulwark and the outboard motor with respect to a fore-to-aft direction, the first part being at least partially disposed in a non-overlapping location with respect to the outboard motor and the bulwark as viewed from a side view of the outboard motor boat, the first part of the aft deck having an upper deck surface that lies either below an upper deck surface of the mid-deck or substantially in a same plane as the upper deck surface of the mid-deck, the at least one seat being disposed on the mid-deck such that the upper deck surface of the mid-deck lies below the at least one seat, a swimming deck being pivotally mounted to the aft deck between an in-use position and a stowed position, the swimming deck being disposed underneath the second part of the aft deck while in the stowed position and disposed rearward of the aft deck while in the in-use position.

19. The outboard motor boat according to claim 18, wherein the swimming deck includes a step that is substantially parallel to the an upper deck surface of the second part of the aft deck while in the in-use position, and that is substantially parallel to a rear face of the hull while in the stowed position.

20. The outboard motor boat according to claim 18, wherein the swimming deck has a pivot angle of 100 degrees to 120 degrees.

* * * * *